US011878201B2

(12) United States Patent
Sisler

(10) Patent No.: US 11,878,201 B2
(45) Date of Patent: Jan. 23, 2024

(54) ADJUSTABLE KETTLEBELL DEVICE

(71) Applicant: Craig Louis Sisler, Meadowview, VA (US)

(72) Inventor: Craig Louis Sisler, Meadowview, VA (US)

( * ) Notice: Subject to any disclaimer, the term of this patent is extended or adjusted under 35 U.S.C. 154(b) by 0 days.

(21) Appl. No.: 18/219,726

(22) Filed: Jul. 10, 2023

(65) Prior Publication Data

US 2023/0364461 A1 Nov. 16, 2023

Related U.S. Application Data

(63) Continuation-in-part of application No. 17/866,579, filed on Jul. 18, 2022, which is a continuation-in-part of application No. 17/408,915, filed on Aug. 23, 2021, now Pat. No. 11,529,542, which is a continuation-in-part of application No. 16/250,611, filed on Jan. 17, 2019, now Pat. No. 11,130,014.

(60) Provisional application No. 62/618,358, filed on Jan. 17, 2018.

(51) Int. Cl.

| | |
|---|---|
| ***A63B 21/075*** | (2006.01) |
| ***A63B 23/12*** | (2006.01) |
| ***A63B 21/072*** | (2006.01) |

(52) U.S. Cl.

CPC ..... *A63B 21/075* (2013.01); *A63B 21/0724* (2013.01); *A63B 21/0728* (2013.01); *A63B 23/12* (2013.01)

(58) Field of Classification Search

CPC ..... A63B 21/072; A63B 21/0724; A63B 21/0726; A63B 21/0728; A63B 21/075; A63B 23/12

See application file for complete search history.

(56) References Cited

U.S. PATENT DOCUMENTS

| | | | | | |
|---|---|---|---|---|---|
| 4,717,147 | A * | 1/1988 | Rochelle | A63B 21/0724 | 482/106 |
| 5,827,157 | A * | 10/1998 | Lee | A63B 21/06 | 482/93 |
| 6,689,022 | B1 * | 2/2004 | Emick | A63B 21/06 | 482/93 |
| D571,418 | S * | 6/2008 | Gormley | D21/680 | |
| 7,491,157 | B1 * | 2/2009 | Lin | A63B 21/072 | 482/107 |
| 7,563,208 | B1 * | 7/2009 | Chen | A63B 21/075 | 482/93 |
| 7,731,640 | B1 * | 6/2010 | Chen | A63B 21/075 | 482/93 |
| 7,815,553 | B2 * | 10/2010 | Song | A63B 21/06 | 482/109 |
| 7,883,452 | B1 * | 2/2011 | Chen | A63B 21/072 | 482/93 |

(Continued)

*Primary Examiner* — Joshua Lee

(74) *Attorney, Agent, or Firm* — Gearhart Law, LLC; David Postolski

(57) ABSTRACT

An adjustable kettlebell device comprising a solid right circular frustum as a base, a post, a sleeve, one or more weight plates, one or more quick release clamps, and a removable handle. The post has an outer diameter compatible with standard weights, and a sleeve that slides over the post has an outer diameter compatible with Olympic weights. The handle is configured to facilitate an addition/removal of the weight plates, and may be swapped with different sized handles for use with different sized hands.

19 Claims, 33 Drawing Sheets

(56) References Cited

U.S. PATENT DOCUMENTS 7,976,443 B2 * 7/2011 Krull ..... A63B 21/0728 482/107
D653,715 S * 2/2012 Tumminia ..... A63B 21/072 D21/679
9,327,159 B1 * 5/2016 Medina ..... A63B 21/0726
9,498,676 B1 * 11/2016 Emick ..... A63B 23/1209
9,616,269 B1 * 4/2017 Burosh ..... A63B 21/0004
10,188,899 B1 * 1/2019 Acuna, Jr. ..... A63B 21/0442
2004/0082442 A1 * 4/2004 Beedy ..... A63B 23/03525 482/109
2004/0162199 A1 * 8/2004 Connelly ..... A63B 21/072 482/109
2006/0035767 A1 * 2/2006 Ekhaus ..... A63B 21/0601 482/50
2008/0081744 A1 * 4/2008 Gormley ..... A63B 21/0728 482/93
2010/0075816 A1 * 3/2010 Anderson ..... A63B 21/0728 482/107
2010/0190619 A1 * 7/2010 Chen ..... A63B 21/072 482/108
2011/0263392 A1 * 10/2011 Yu ..... A63B 21/072 482/93
2012/0252641 A1 * 10/2012 Odneal ..... A63B 21/072 482/108
2013/0040789 A1 * 2/2013 Kessler ..... A63B 21/072 482/108
2014/0024506 A1 * 1/2014 Vixathep ..... A63B 21/072 482/108
2014/0057764 A1 * 2/2014 Klukas ..... A63B 15/00 482/109
2014/0287891 A1 * 9/2014 Marich ..... A63B 21/072 482/108
2015/0105224 A1 * 4/2015 Odneal ..... B22D 17/00 164/47
2015/0174445 A1 * 6/2015 Robertson, Jr. ..... A63B 21/075 482/93
2016/0144219 A1 * 5/2016 Koenig ..... A63B 21/075 482/93
2017/0246495 A1 * 8/2017 Wyncott ..... A63B 21/072
2017/0259106 A1 * 9/2017 Pawlas ..... A63B 21/072
2018/0117387 A1 * 5/2018 Wang ..... A63B 21/075
2018/0169460 A1 * 6/2018 Chen ..... A63B 21/075

* cited by examiner

ADJUSTABLE KETTLEBELL DEVICE

CROSS-REFERENCE TO RELATED APPLICATION

The present application is a U.S. Non-Provisional Patent Application and Continuation-in-Part Application (CIP) of U.S. Non-Provisional patent application Ser. No. 17/866,579 filed on Jul. 18, 2022, which claims priority to U.S. Non-Provisional Patent Application and Continuation Application of U.S. Non-Provisional Patent Application S/N 17,408915 filed on Aug. 23, 2021 and patented as U.S. Pat. No. 11,529,542 on Dec. 20, 2022, which claims priority to U.S. Non-Provisional patent application Ser. No. 16/250,611 filed on Jan. 17, 2019 and patented as U.S. Pat. No. 11,130,014 on Sep. 28, 2021, and which claims priority to U.S. Provisional Patent Application Ser. 62/618,358 filed on Jan. 17, 2018, the contents of all of which are incorporated herein by reference in their entireties.

BACKGROUND

Statement of the Technical Field

The present disclosure relates generally to exercise devices. More particularly, the present disclosure relates to adjustable kettlebell devices.

Description of the Related Art

The traditional kettlebell is a cast-iron or cast steel weight (resembling a cannonball with a handle) used to perform all types of exercises, including but not limited to ballistic exercises that combine cardiovascular, strength and flexibility training. The Russian kettlebell was a type of metal weight, primarily used to weigh crops, in the 18th century. Kettlebells began to be used for recreational and competition strength athletics in Russia and Europe in the late 19th century with the birth of competitive kettlebell lifting dating back to 1885. The use of kettlebells in exercise programs in the USA and Western Europe is a relatively recent phenomenon but has quickly gained momentum in recent years as evidenced by the increased use in home gyms as well as public gyms and athletic clubs. This is understandable because, by their nature, typical kettlebell exercises build strength and endurance, particularly in the lower back, legs, and shoulders, and increase grip strength. The basic movements, such as the swing, snatch, and the clean and jerk, engage the entire body at once, and in a way that mimics real world activities. Furthermore, research has demonstrated not only that the unique biomechanics of certain kettlebell exercises transfers well to certain key sporting movements but that, in general, the potential power and strength benefits of kettle bell training provide a viable alternative to traditional resistance training methods. In addition, kettlebells are now widely used not only in numerous types on anaerobic exercise but also in many types of aerobic exercise. Studies have shown that kettlebells are not only beneficial in when used in ballistic and anaerobic activity but can be very effectively used as a complementary or alternative mode of improving cardiovascular fitness. Furthermore, studies also show that kettlebells can play an important role in the domain of physical therapy and rehabilitation.

The typical traditional kettlebell is a non-adjustable, cast iron weight which requires the purchase of a set of kettle bells in order to allow for the performance of different types of exercises and/or to vary the amount of weight used depending on the exercise and the strength of the user. This can be very expensive with the cost of a full set of kettle bells ranging from, for example, $1000 to over $2,000. In addition to the considerable expense, a full set of kettlebells requires a significant amount of space for storage.

SUMMARY

The present disclosure concerns implementing systems and methods for using an adjustable kettlebell device. The methods comprise: decoupling a handle from a post having a first outer diameter that allows the adjustable kettlebell device to be compatible with a first weight plate of a first type; sliding the first weight plate on the post; coupling the handle to the post so that the first weight plate is retained on the post and is movable in unison with the handle, post and base; using the post to prevent horizontal movement of the first weight plate relative to the base and handle when the adjustable kettlebell device is being held by a user for exercise purposes during a first time period; decoupling the handle once again from the post; removing the first weight plate from the post; sliding a sleeve over the post (where the sleeve has a second outer diameter that allows the adjustable kettlebell device to be compatible with a second weight plate of a second type different from the first type); sliding the second weight plate on the sleeve; coupling the handle to the post once again so that the second weight plate is retained on the sleeve and is movable in unison with the handle, post and base; and using the sleeve to prevent horizontal movement of the second weight plate relative to the base and handle when the adjustable kettlebell device is being held by the user for exercise purposes during a second time period.

The methods may also comprise: using the post or sleeve to structurally support the handle and maintain the handle's position relative to the base; using the post or sleeve to limit a distance in which the handle can travel along the post towards the base; optionally securing a pin or clamp (or other securing mechanism) through or around the post above the handle to prevent vertical movement away from the base; securing a clamp (or other securing mechanism) to the post below the handle so as to prevent vertical movement of the first weight plate along an elongate length of the post during the first period of time when the adjustable kettlebell device is being used for exercise purposes; and/or adapting the adjustable kettlebell device for various reasons (including, but not limited to, the user's hand size, general comfort, or other ergonomic requirements or aesthetic need) by replacing the handle with another handle of a plurality of interchangeable handles.

In other scenarios, the methods comprise: decoupling a handle from a post; sliding a first sleeve over the post, where the first sleeve has a height that is shorter than the height of the post and/or has a first outer diameter that allows the adjustable kettlebell device to be compatible with a first weight plate of a first type; sliding the first weight plate on the first sleeve; optionally adding a clamp (or other securing mechanism) to keep the first weight from sliding away from the base should the device be used in a swinging motion or other form of motion; coupling the handle to the post so that the first weight plate is retained on the first sleeve and is movable in unison with the handle, post and base; using the first sleeve to prevent horizontal movement of the first weight plate relative to the base and handle when the adjustable kettlebell device is being held by a user for exercise purposes during a first time period; optionally using the first sleeve with its wider outer diameter to support the handle and prevent it from sliding toward the base; decoupling the handle once again from the post; removing the first weight plate from the first sleeve; sliding a second sleeve over the post or first sleeve (where the second sleeve has a height that is shorter than the height of the post and/or has a second outer diameter that allows the adjustable kettlebell device to be compatible with a second weight plate of a second type different from the first type); sliding the second weight plate on the second sleeve; optionally adding a clamp (or other securing mechanism) to keep the first weight from sliding away from the base should the device be used in a swinging motion or other form of motion; coupling the handle to the post once again so that the second weight plate is retained on the second sleeve and is movable in unison with the handle, post and base; and using the second sleeve to prevent horizontal movement of the second weight plate relative to the base and handle when the adjustable kettlebell device is being held by the user for exercise purposes during a second time period.

In some scenarios, the adjustable kettlebell device comprises: a base; a first part coupled or coupleable to the base and having a first outer diameter that allows the adjustable kettlebell device to be compatible with a first weight plate which is of a first type; a second part coupleable to the first part and having a second outer diameter that allows the adjustable kettlebell device to be compatible with the second weight plate which is of a second type different from the first type; and a removable handle configured to facilitate (A) an addition or removal of the first and second weight plates from the adjustable kettlebell device, (B) a retention of the first weight plate on the first part, and (C) a retention of the second weight plate on the second part.

In some scenarios, the adjustable kettlebell device comprises: a base; a post having a first end that is securely coupled to the base and configured to slidingly receive a first weight plate thereon; at least one sleeve disposed on the post and configured to slidingly receive a second weight plate thereon; and a handle removably coupled to the post. The post has a first outer diameter that allows the adjustable kettlebell device to be compatible with the first weight plate which is of a first type. The sleeve has a second outer diameter that allows the adjustable kettlebell device to be compatible with the second weight plate which is of a second type different from the first type. The handle is configured to facilitate (A) an addition or removal of the first and second weight plates from the adjustable kettlebell device, (B) a retention to the first weight plate on the post, and (C) a retention of the second weight plate on the sleeve. The post is used to prevent horizontal movement of the first weight plate relative to the base and handle when the adjustable kettlebell device is being held by a user for exercise purposes during a first time period.

The post is used to prevent horizontal movement of the first weight plate relative to the base and handle when the adjustable kettlebell device is being held by the user for exercise purposes during a first time period. The sleeve which is slid down onto the post prevents horizontal movement of the second weight plate relative to the base and handle when the adjustable kettlebell device is being held by the user for exercise purposes during a second time period.

The post or sleeve is used to: structurally support the handle and maintain the handle's position relative to the base; and/or limit a distance in which the handle can travel along the post towards the base. A clamp (or other securing mechanism) may be secured to the post so as to prevent vertical movement of the first weight plate along an elongate length of the post. A plurality of interchangeable handles may be provided that are configured to facilitate an adaption of the adjustable kettlebell device to the user's hand size (or for any of a number of other ergonomic or aesthetic purposes).

In some scenarios, the adjustable kettlebell device comprises: a base; a post having a first end that is securely coupled to the base; a first sleeve for the post that is configured to slidingly receive a first weight plate thereon; a second sleeve for the post that is configured to slidingly receive a second weight plate thereon; and a handle removably coupled to the post. The first sleeve has a first outer diameter that allows the adjustable kettlebell device to be compatible with the first weight plate which is of a first type. The second sleeve has a second outer diameter that allows the adjustable kettlebell device to be compatible with the second weight plate which is of a second type different from the first type. The handle is configured to facilitate (A) an addition or removal of the first and second weight plates from the adjustable kettlebell device, (B) a retention to the first weight plate on the first sleeve, and (C) a retention of the second weight plate on the second sleeve. The first sleeve is used to prevent horizontal movement of the first weight plate relative to the base and handle when the adjustable kettlebell device is being held by a user for exercise purposes during a first time period. The second sleeve to prevent horizontal movement of the second weight plate relative to the base and handle when the adjustable kettlebell device is being held by the user for exercise purposes during a second time period.

The post, first sleeve or second sleeve is used to: structurally support the handle and maintain the handle's position relative to the base; and/or limit a distance in which the handle can travel along the post towards the base. The adjustable kettlebell device may further comprise a clamp (or securing mechanism) that is configured to be coupled to: the first sleeve so as to prevent vertical movement of the first weight plate along an elongate length of the first sleeve during the first period of time; and/or the second sleeve so as to prevent vertical movement of the second weight plate along an elongate length of the second sleeve during the second period of time.

BRIEF DESCRIPTION OF THE DRAWINGS

The present solution will be described with reference to the following drawing figures, in which like numerals represent like items throughout the figures.

DETAILED DESCRIPTION

Figure 1:
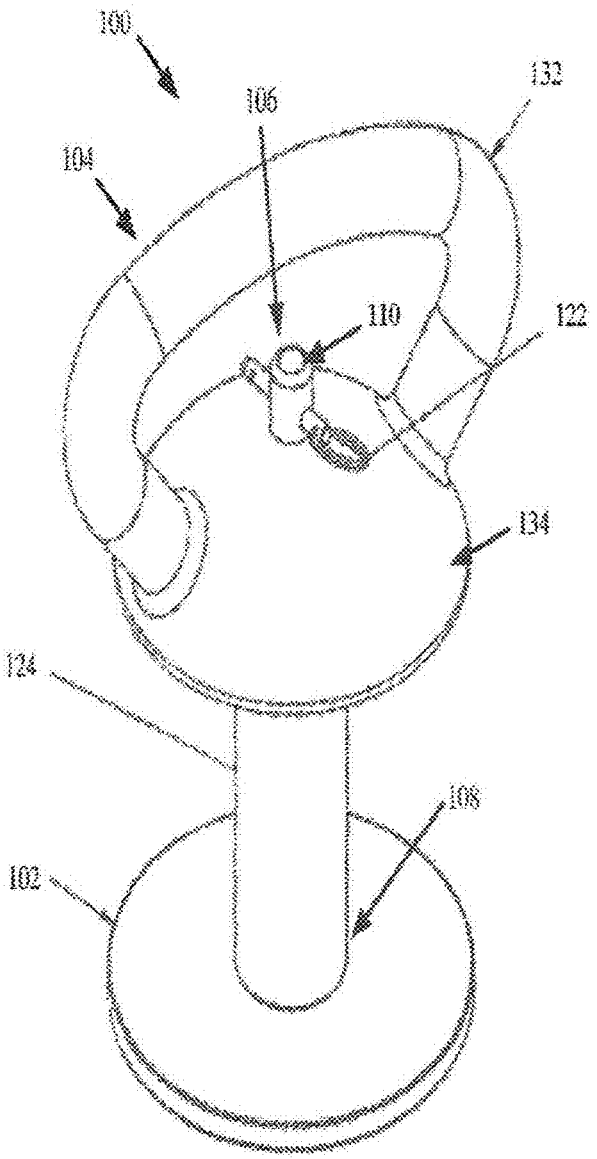
FIG. 1 is a perspective view of an adjustable kettlebell device with a kettle handle.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Kettlebells are an extremely versatile piece of exercise equipment. They can be used for many kinds of fitness and exercise activities including, but not limited to, ballistic training, weight training and other forms of anaerobic exercise as well as aerobic/cardiovascular and other types of fitness training. Kettlebells can also be used in physical therapy and rehabilitation. However, in a group or multi-user setting—for example, in a gym, health club or physical therapy establishment, a tremendous range of activities and exercises must be accommodated as well as a huge variance in body types, levels of strength and fitness and so on. In such circumstances, a full set of traditional kettle bells would be required. This can be expensive: a set of kettlebells ranging from 5 to 100 lbs. costs from $1,300 to over $2,300 (more for a larger set); and that is the cost for a single set of 15 kettlebells which are each a different weight so, in order to perform movements with two kettlebells of identical weight (which is very common), additional kettle bells would be required. It is also the case that even a single set of kettle bells takes up a large amount of space. For an individual who wishes to enjoy the benefits of kettlebell training but who may not be able to, or wish to, exercise in a health club or similar group setting, a large set of kettle bells is still required if they wish to perform a wide range of activities and exercises some of which may require very light weight loads (as little as 10 lbs. or less) and some of which will require exponentially larger weight loads (as much as 80-100 lbs. or more). As a result, for the individual user, the significant expense and storage requirements are magnified and may even be prohibitive. Furthermore, kettlebell weights above fifteen pounds generally come in increments of no less than five pounds which limits the ability to very gradually increase or decrease the weight used which, in turn, can limit the range of exercises performed and/or limit the ability of the user to make desired small advances in training. With all of this said, there are numerous aspects of the traditional kettle bell that make use of the device so appealing: the ergonomics and "feel" of a kettlebell are unique and lend themselves to beneficial exercises that are difficult or unsafe to perform with other devices or equipment; due to their design, kettlebells perform well in a wide variety of exercises and modes of exercise; changing the amount of weight used is as fast and simple as putting one kettle bell down and picking up another—this is very important for the user both mentally (the ability to quickly change weights and/or move briskly from one type of exercise to the next allows the user to concentrate on their training) and physiologically (by maintaining an appropriately elevated heart rate when desired); notwithstanding the expense of owning a large set of kettlebells, the vast range in weight of kettlebells from 5 lbs. to well over 100 lbs. also contributes tremendously to the flexibility of the traditional kettle bell in supporting a broad range of exercises, modes of exercises and the variability in different users' size, strength, agility and other individual attributes.

Accordingly, there is a need for an adjustable kettlebell device that: (A) addresses the problems or negative aspects of traditional kettlebells (high cost of ownership; large demand on storage space; limitation on incremental weight increases/decreases), (B) retains the desirable aspects of a traditional kettlebell (unique ergonomic design and feel; safety, ease of use; fast and simple changes in weight; great flexibility in the range of weight that can be used), and (C) ideally, improves upon the traditional kettlebell in new, useful ways including, but not limited to: the simplicity, flexibility, and reduced cost of ownership by allowing use of non-standard, customized weight plates and/or non-proprietary Commercial-Off-The-Shelf ("COTS") weight plates that are already in the possession of the user (or easily obtained); broader choices in exercises and modes of exercise enable by the use of different interchangeable types, styles and weights of kettle bell handles for increased flexibility in training.

It does not appear that any of the existing adjustable kettlebell devices currently available in the marketplace or existing in prior art resolve all of the problems noted above that exist with traditional kettle bells nor do they retain all of the aforementioned desirable attributes of traditional kettle bells and incorporate all the improvements also noted above. For example, in some existing adjustable kettlebell devices and systems (such as the those made/marketed by Ironmaster, Fitness Gear, Marcy, PowerBlock, Kettle Grp), the increasing and decreasing of weight tends to require an awkward process that involves laying the device on its side and/or unscrewing/unlocking a cumbersome mechanical coupler in order to adjust the weight. Such methods detrimentally slow down the training process which, as noted earlier, can disrupt the concentration of the user on their training regimen and/or interfere with maintaining an elevated heart rate which is often integral to an exercise program. Furthermore, some of these devices have a maximum weight capacity of less than sixty pounds which can (A) limit the number and type of exercises that can be performed, (B) limit the intensity of a training program, and (C) serve as an impediment to advanced training. Further, some of these existing adjustable kettle bell devices require use of proprietary weight plates that are only compatible with the given exercise system. This approach can (A) increase cost of ownership by not allowing the user to utilize equipment they may already own and (B) sets a limit on how much weight can be used. Most, if not all, existing products and prior art do not give the user the choice between non-standard, customized weight plates, and/or non-proprietary Commercial-Off-The-Shelf ("COTS") standard weight plates, and Olympic weight plates which thereby limits exercises options and increases the cost of ownership. Other existing adjustable kettlebell devices require that the user possess specific equipment in order for the adjustable kettlebell device to function which, again, can restrict exercise and training options and increase the cost of ownership. Other existing, representative systems which also exhibit one or more deficiencies in addressing the aforementioned issues are described in U.S. Patent Publication Nos. 2008/0081744, 2016/0236029, 2015/0231440, 2015/0196792, 2015/0105224 and 2008/0081744.

Therefore, the present disclosure concerns adjustable kettlebell devices that address at least some of the above-mentioned issues. Exemplary embodiments of adjustable kettlebell devices will now be described in detail.

Generally, the adjustable kettlebell device comprises: a base; a first part coupled or coupleable to the base and having a first outer diameter that allows the adjustable kettlebell device to be compatible with a weight plate which is of a first type; a second part coupleable to the first part and having a second outer diameter that allows the adjustable kettlebell device to be compatible with the weight plate which is of a second type different from the first type; and a removable handle configured to facilitate (A) the fast and simple addition or removal of the first and second types of weight plates from the adjustable kettlebell device, (B) a retention to the first type of weight plate on the first part, and (C) a retention of the second type of weight plate on the second part.

Illustrative Adjustable Kettlebell Devices

Referring now to FIGS. 1-4, there are provided illustrations that are useful for understanding an adjustable kettlebell device 100 in accordance with the present solution. The adjustable kettlebell device 100 is compatible with different types of weights. Accordingly, the adjustable kettlebell device 100 is configured to allow for a simple and fast adjustment of weight by adding thereto or removing therefrom weight plates (as described below in relation to FIGS. 11-17) of different types. In this regard, the device provides tremendous flexibility in that the weight plates may include, but are not limited to, non-standard or custom weight plates, standard weight plates (e.g., weight plates with center apertures having one inch diameters), and Olympic weight plates (e.g., weight plates with center apertures having two inch diameters).

As shown in FIGS. 1-4, the adjustable kettlebell device 100 comprises a base 102, a handle 104 and a post 106. The handle 104 is provided to allow a user to grasp, hold, carry or otherwise move the adjustable kettlebell device 100. The handle 104 has a shape and size similar to that of conventional kettlebell handles. In this regard, the handle 104 is also referred to herein as a kettle handle. The kettle handle 104 has a curved grip portion 132 and a body portion 134. The curved grip portion 132 is sized and shaped such that it can be gripped by one or two hands. The body portion 134 has a dome shape. The handle 104 is formed of any suitable material, such as metal, rubber, plastic or composite material.

Figure 5:
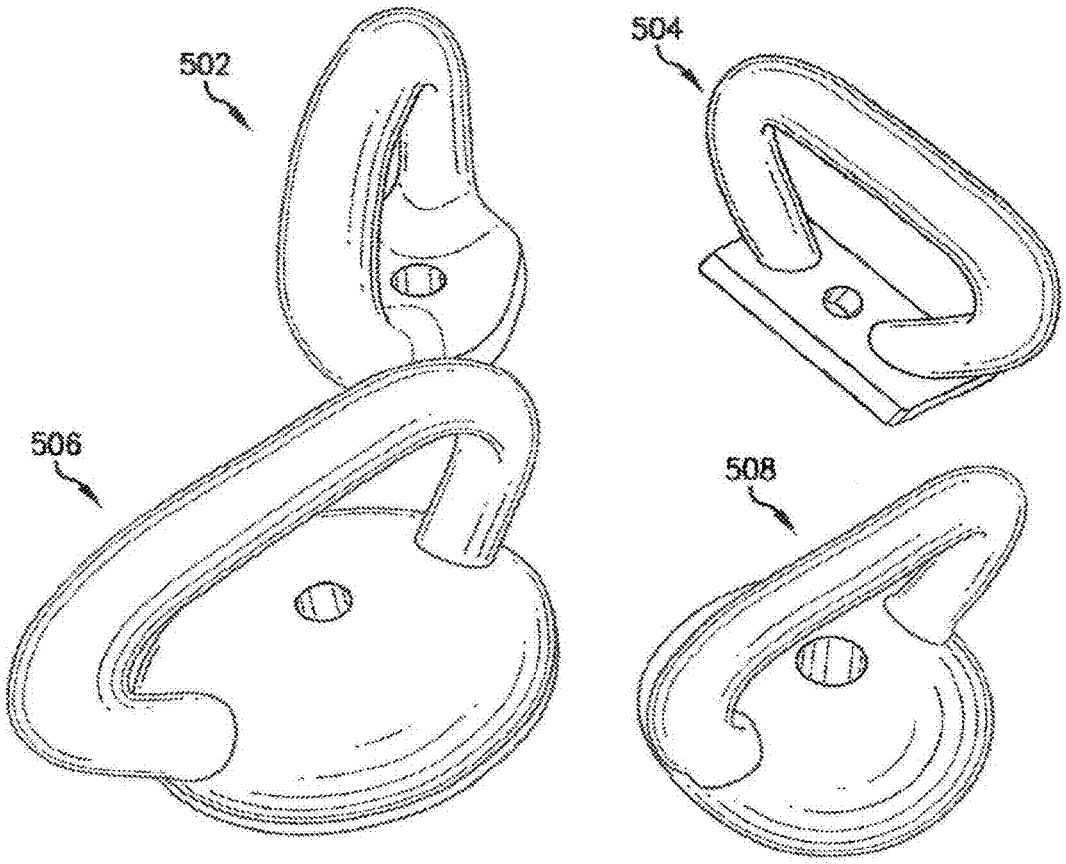
FIG. 5 provides perspective views of other handles which are interchangeable with the kettle handle shown in FIG. 1.

The present solution is not limited to the kettle handle design shown in FIGS. 1-4. Other exemplary handle designs are shown in FIG. 5. These other handle designs include, but are not limited to, block handle designs. The kettle handles and block handles can have various overall sizes. For example, the kettle handles include a large kettle handle 506 and a small kettle handle 508. Similarly, the block handles include a large block handle 502 and a small block handle 504. Notably, the handles 502-508 are interchangeable with handle 104 of FIG. 1. These interchangeable handles allow the adjustable kettlebell device 100 to be easily adapted for any user's hand size and/or comfort (or for any of a number of other ergonomic or aesthetic purposes).

Referring again to FIGS. 1-4, the post 106 is coupled between the base 102 and handle 104. These components 102-106 are formed from any suitable material. For example, in some scenarios, the base 102 and post 106 are metal components welded together at interface 108. The present solution is not limited in this regard. Alternatively, the base 102 and post 106 are coupled together via other coupling means (e.g., a bolt or screw) or integrally formed as a single piece during a casting or molding of some other process using one of various types of metal, rubber, plastic or composite material.

The post 106 is sized and shaped to receive one or more weight plates and/or sleeves. In this regard, the handle 104 is removably secured to an end 110 of the post 106 via a securement means such as a pin 122. The handle 104 has an aperture 200 formed therethrough that is sized and shaped to receive the post 106, and the post's end 110 has a through hole 202 formed therein that is sized and shaped to receive the pin 122, as shown in FIG. 1. The handle 104 is securely coupled or locked to the post 106 when the pin 122 is fully inserted into the through hole 202. The handle 104 can be decoupled from the post 106 simply by removing the pin 122 from the through hole 202. Note that this ability to quickly slide the kettle handle on and off the post, taken together with a fast and simple means of securing the handle to the post contributes to a fast and efficient process for changing the weight of the device.

Figure 10:
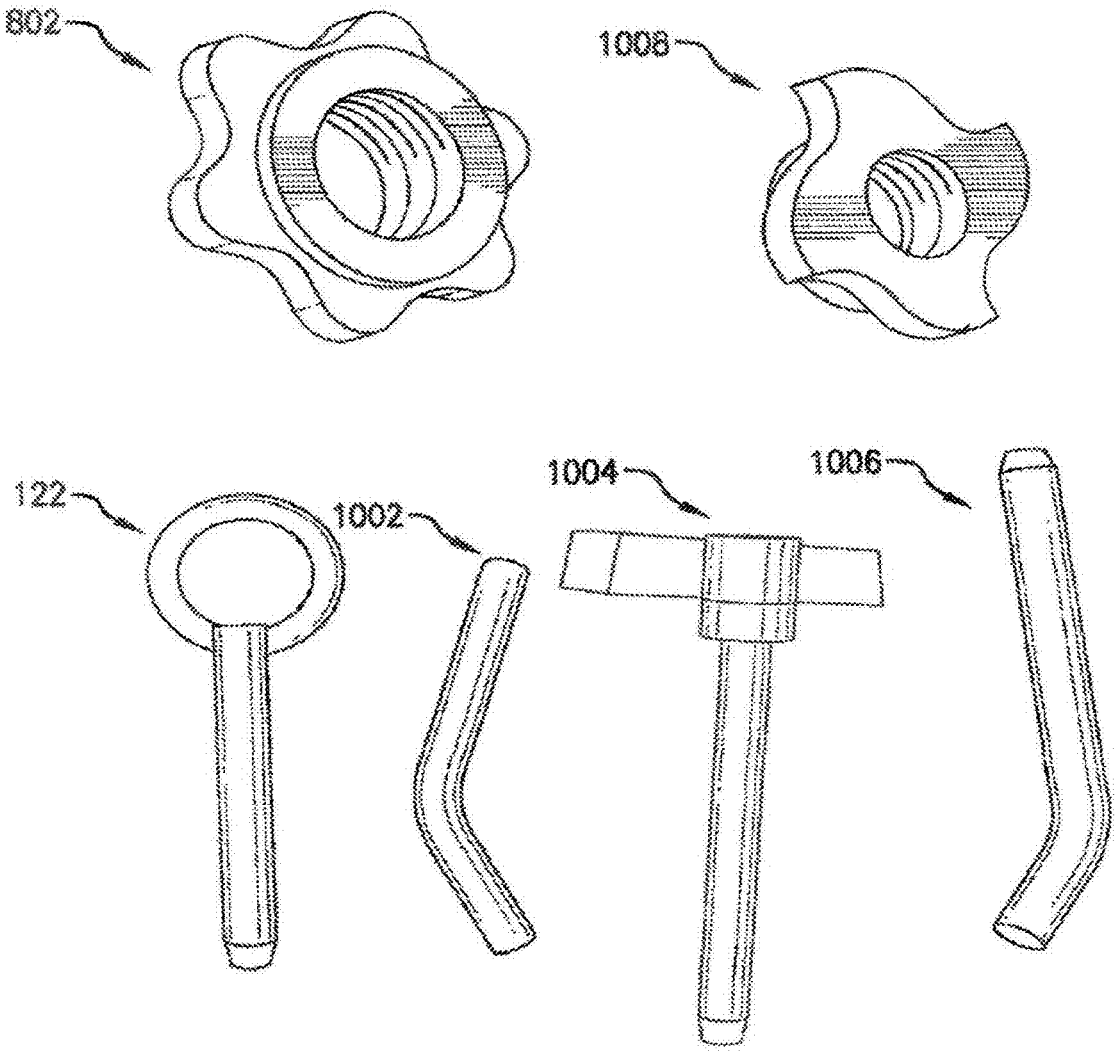
FIG. 10 shows various coupling mechanisms for coupling a handle to a post of an adjustable kettlebell device.

The present solution is not limited to the pin design shown in FIG. 1. Other pin designs 1002-1006 are shown in FIG. 10. The through hole formed in the post can be sized and shaped to receive any given pin 122, 1002-1006 selected in accordance with a particular application.

Figure 8:
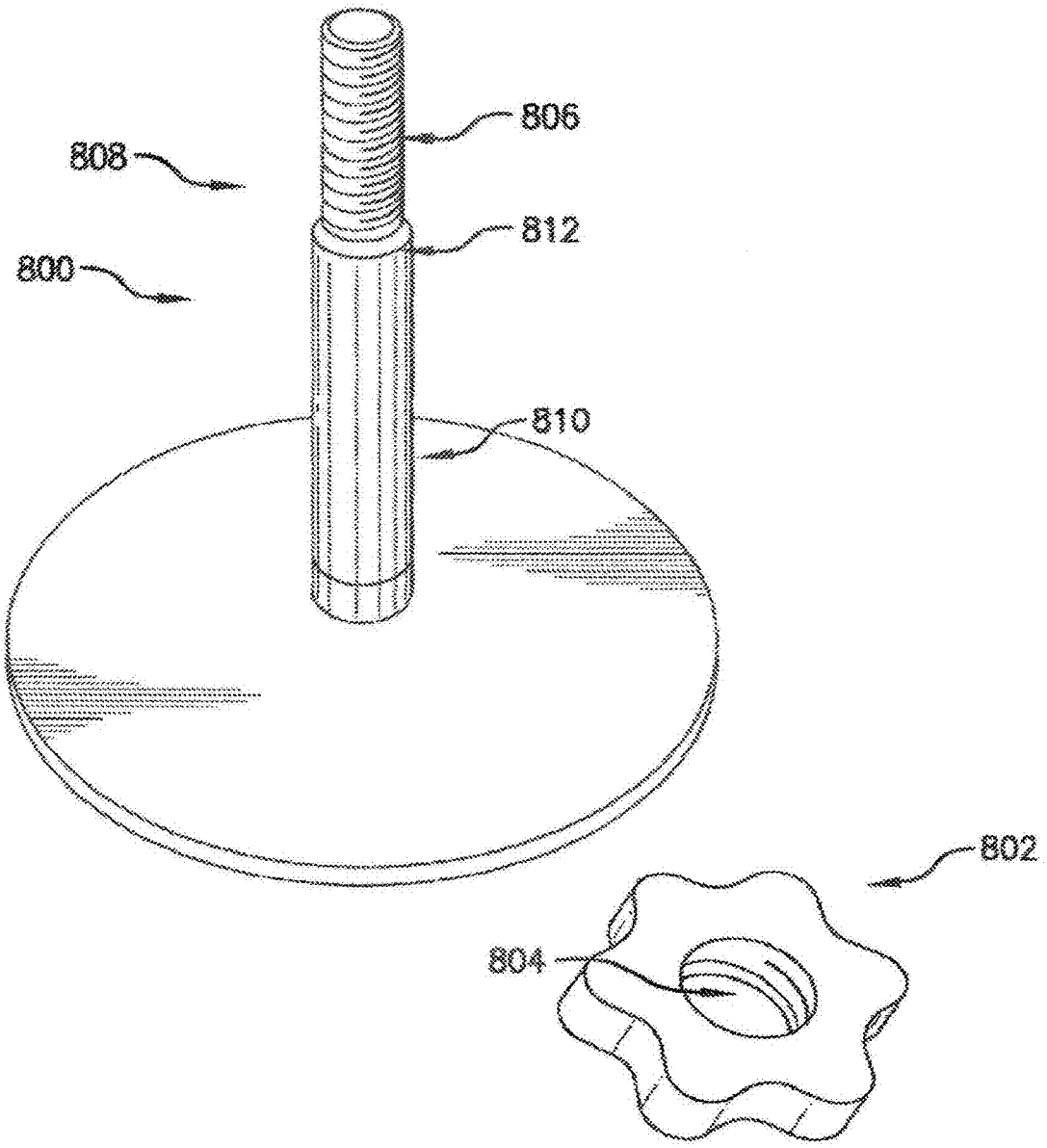
FIG. 8 provides an illustration that is useful for understanding how a handle is coupled to a post of an adjustable kettlebell device.
Figure 9:
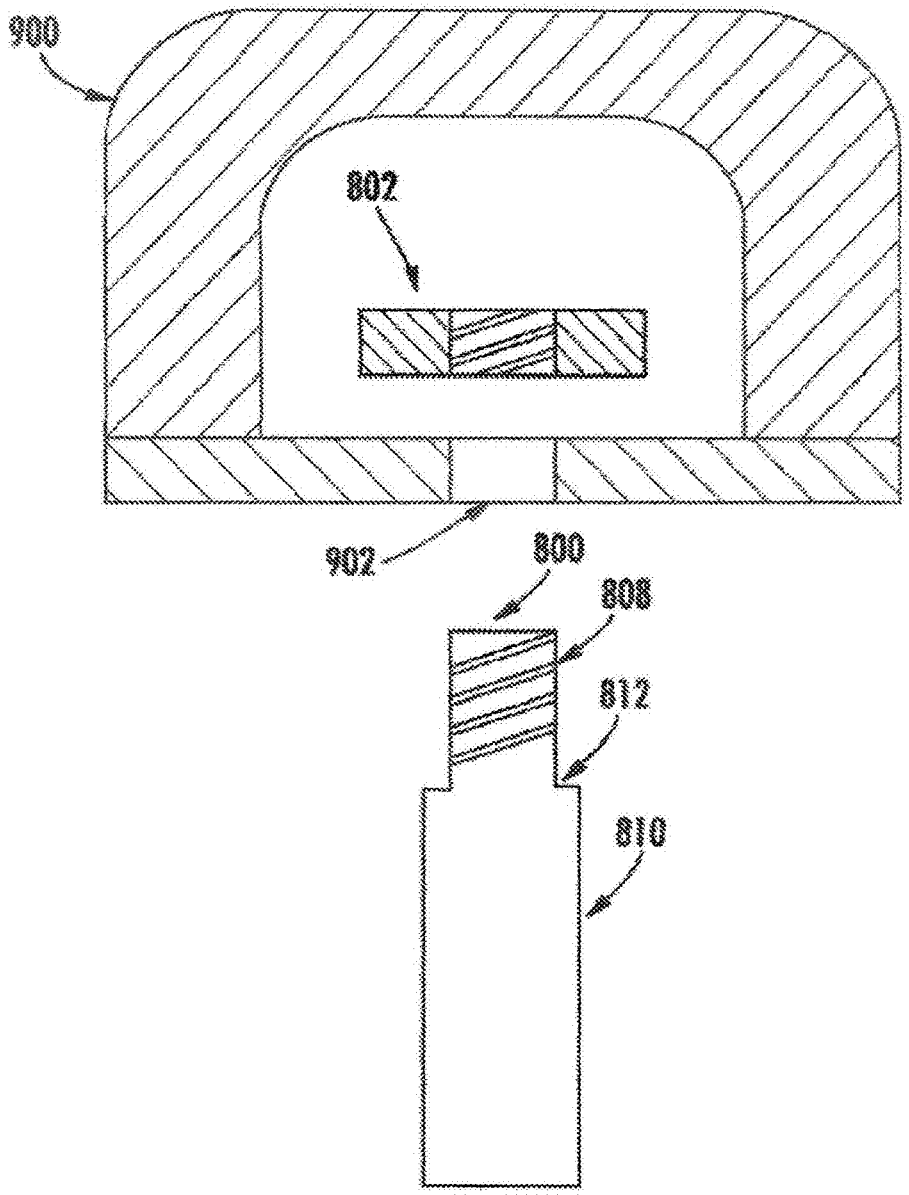
FIG. 9 is a cross-sectional view that is useful for understanding how a handle is coupled to a post of an adjustable kettlebell device.

The present solution is also not limited to the pin configurations 122, 1002-1006 for coupling the handle to the post. In this regard, it should be understood that the securement means can include, but is not limited to, a pin, a nut, a latch, and/or other mechanical securement mechanism. For example, as shown in FIGS. 8-9, a nut 802 is provided with a threaded hole 804. Mating threads 806 are provided on the post 800. In this way, the handle 900 is coupled to the post 800 by: inserting the threaded end 808 of the post 800 into an aperture 902 formed in the handle 900; placing the nut 802 on the threaded end 808 of the post 800; and turning the nut 802 until it is sufficiently tightened.

The present solution is not limited to the nut design shown in FIGS. 8-9. Another nut design is shown in FIG. 10. The threaded end of the post can be configured to allow mating engagement with any given nut 802, 1008 selected in accordance with a particular application.

Figure 33:
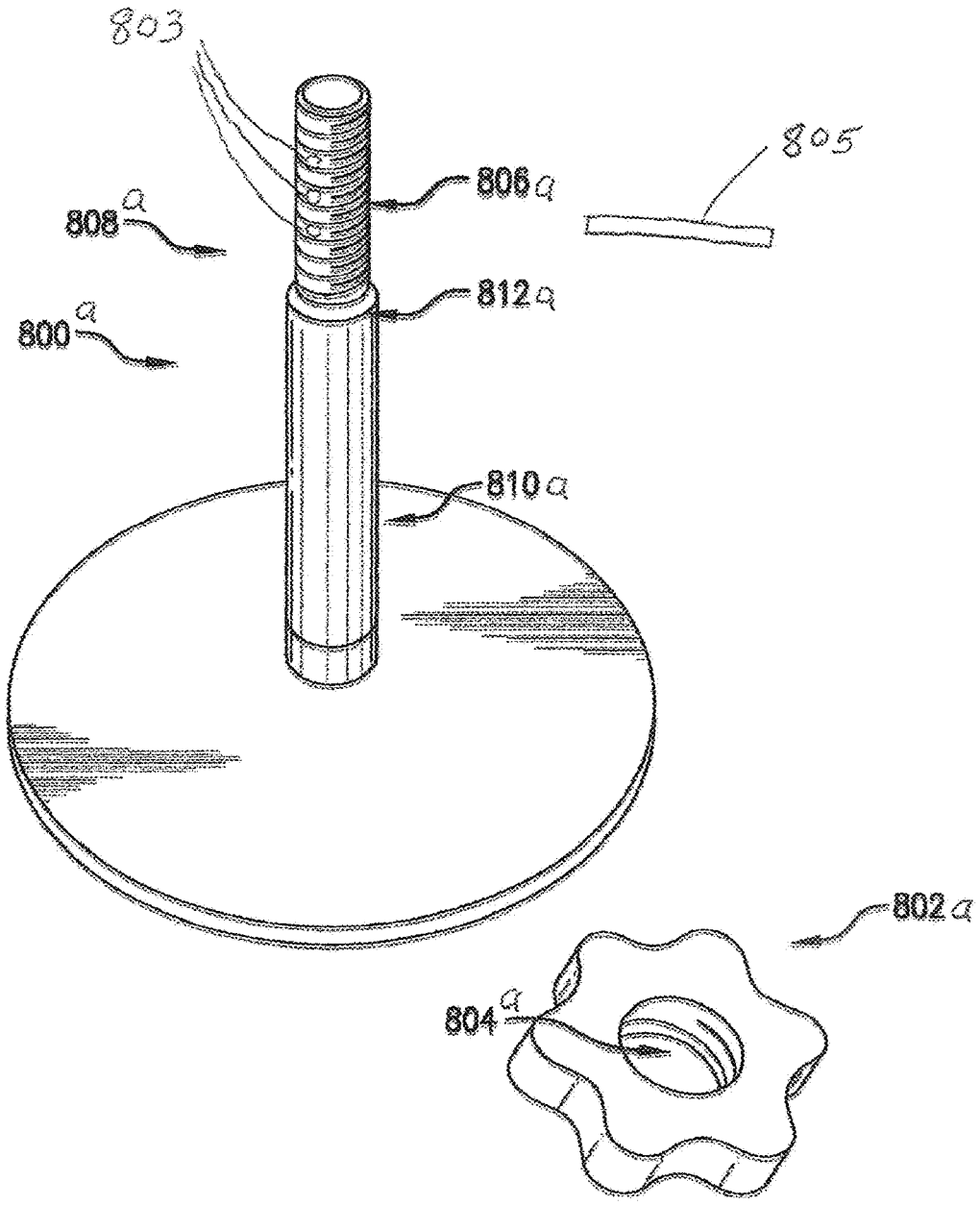
FIG. 33 provides an illustration of a portion of the components of an adjustable kettlebell device having more than one securement mechanism for coupling the handle to the post.
Figure 34:
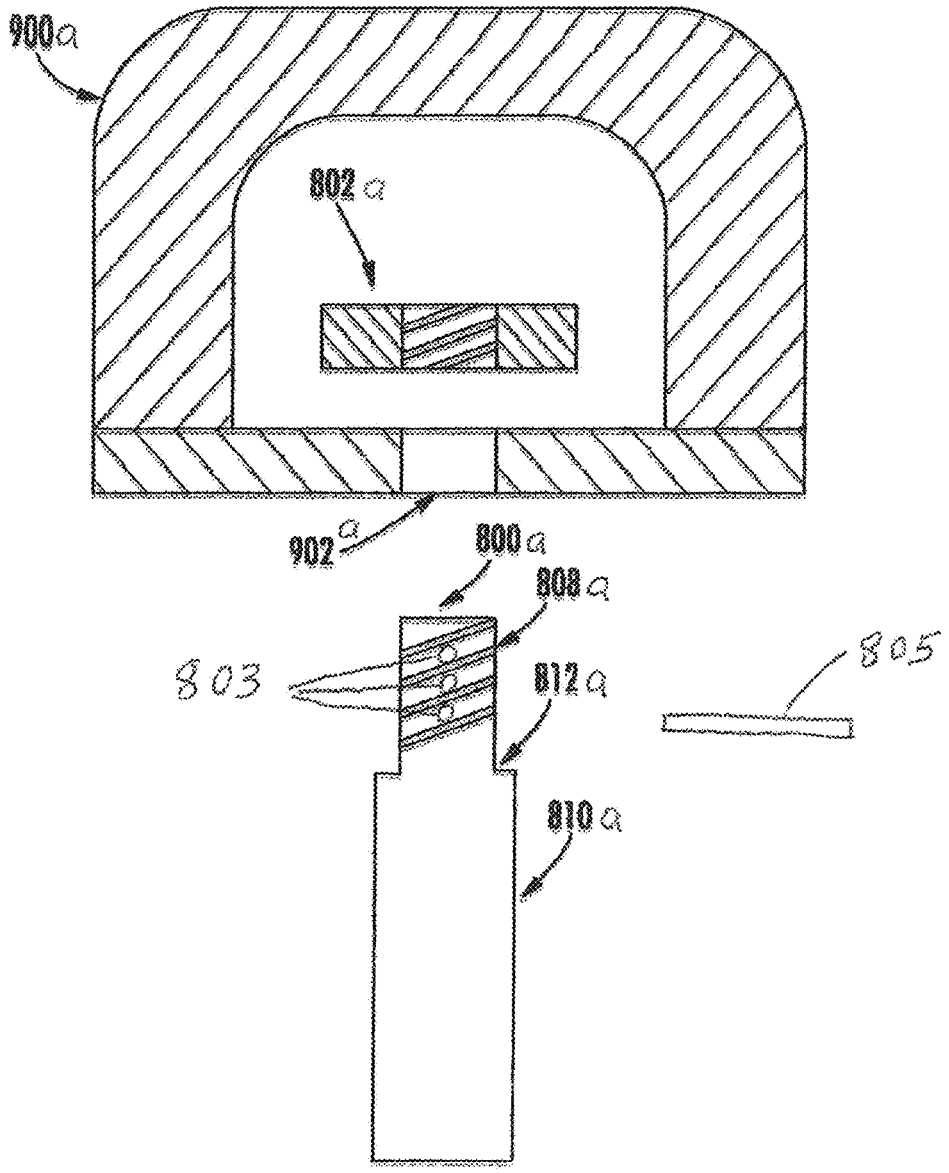
FIG. 34 provides a cross-sectional view of a portion of the components of the adjustable kettlebell device of FIG. 33.
Figure 35:
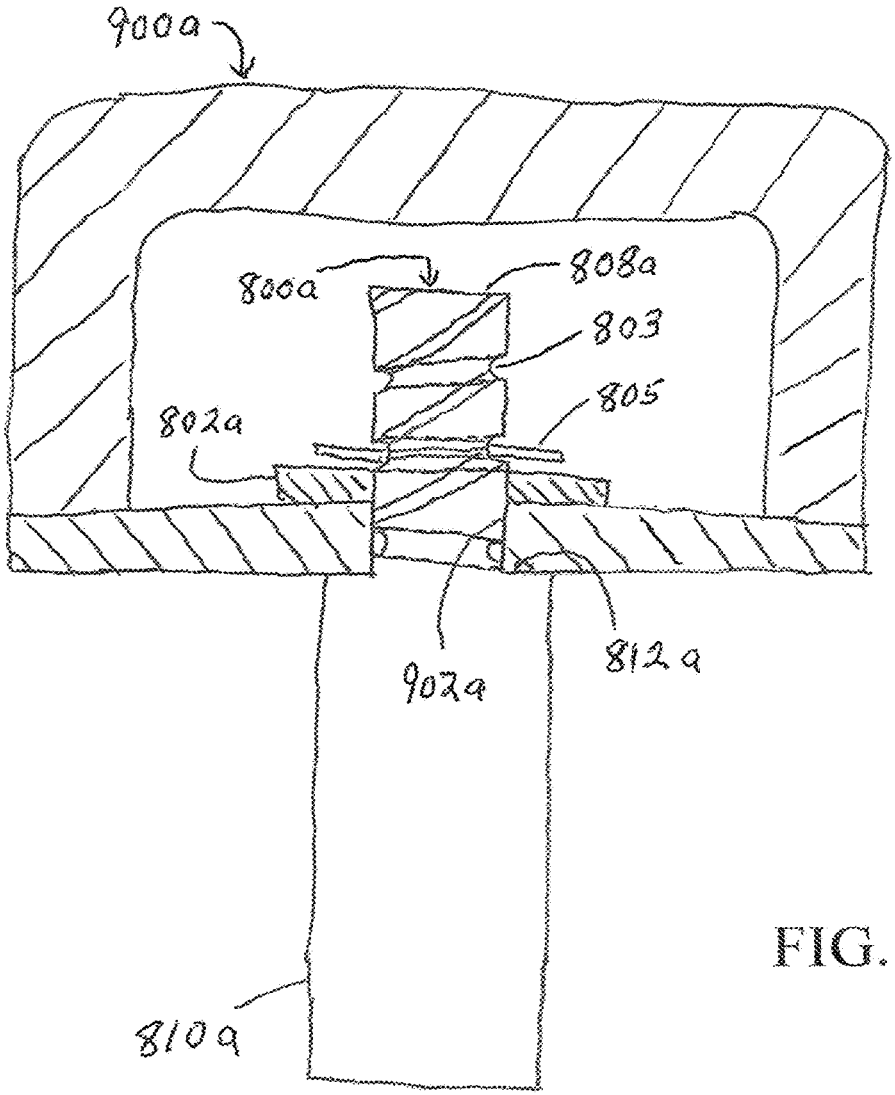
FIG. 35 provides an illustration of the components of the adjustable kettlebell device of FIG. 34 assembled where the post is rotated 90 degrees counterclockwise relative to FIG. 34 as viewed from above and the pin is inserted through an opening above the nut.

In some scenarios, the post is configured to allow for use of a single type of securement mechanism for coupling the handle to the post. In other scenarios, the post is configured to allow for use of two or more different types of securement mechanisms for coupling the handle to the post. For example, the post can have a threaded end for threadingly engaging a nut and an aperture formed through the threaded end for receiving a pin. For example, as shown in FIGS. 33 and 34, the post 800*a* may have, in addition to the threads 806*a*, openings 803 through which a pin 805 may be inserted for coupling the handle 900*a* to the post. In such a configuration, the handle 900*a* would also be coupled to the post 800*a* by the nut 802*a* threadingly engaging the post, the precursor of which is shown in FIG. 34. FIG. 35 shows an example of the nut 802*a* threadingly engaging the post 800*a* and the pin 805 inserted into an opening 803 above the nut 802*a*. Accordingly, the handle 900*a* may be removably coupled to the post 800*a* by a pin 805 inserted through an opening 803 proximate the second end of the post that coincides with the upper end of the post. A threaded nut 802*a* may be twisted onto matching threads 806*a* on the post 800*a* adjacent to the second end of the post such that an opening 803 proximate the second end of the post is above the threaded nut. The present solution is not limited in this regard.

Referring again to FIGS. 1-4, a stop mechanism can optionally be provided on the post 106 to limit how far down the post 106 the handle can be moved. The stop mechanism can include, but is not limited to, a lip, a ledge, a post or other structure protruding out and away from the post 106.

Figure 22:
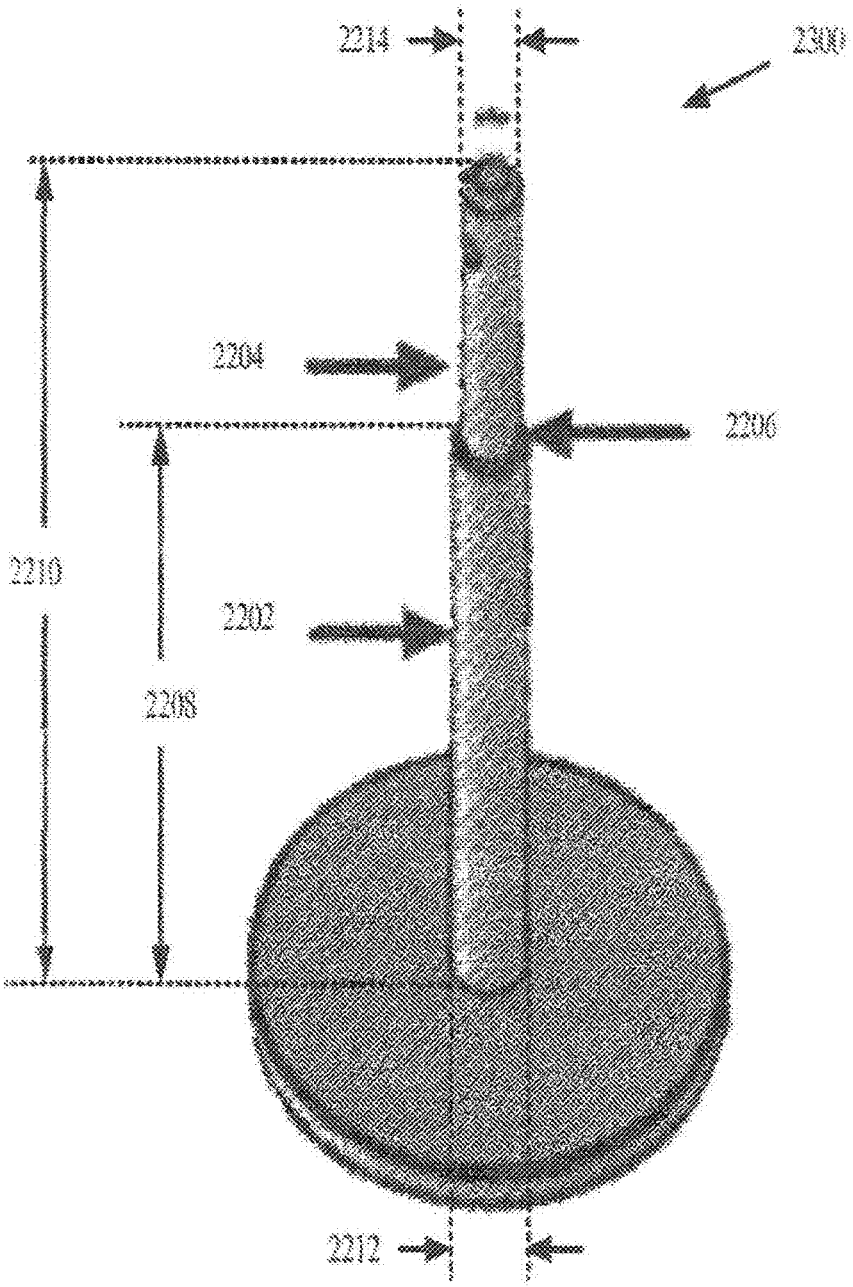
FIG. 22 is a perspective view of an illustrative multi-diameter (or multi-tiered) post and base architecture that is useful for understanding the present solution.

In the lip or ledge scenarios, the post can have a bottom portion 2202 with a first diameter and an upper portion 2204 with a second diameter smaller than the first diameter as shown in FIG. 22. This multi-diameter post provides a lip or ledge 2206 on which the handle can rest and be supported when coupled to the post. In this scenario, the bottom portion 2202 of the post has a height 2208 that is shorter or smaller than the total height 2210 of the post and a diameter 2212 that is larger than the diameter 2214 of the post, as also shown in FIG. 22. Accordingly, the lip 2206 is provided on which the handle can rest when coupled to the post.

The lip or ledge scenario can also be seen in FIGS. 8 and 9, wherein the post 800 can have a bottom portion 810 with a first diameter and an upper portion 808 with a second diameter smaller than the first diameter. Again, this multi-tiered or multi-diameter post provides a lip or ledge 812 on which the handle can rest or be supported when coupled to the upper post.

Figure 2:
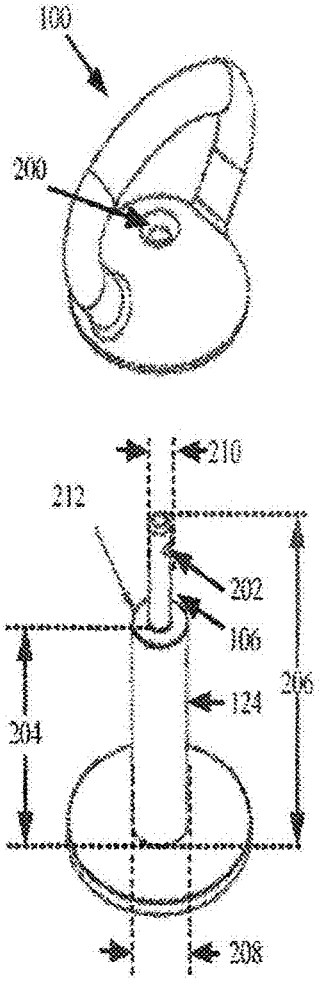
FIG. 2 is a perspective view of the adjustable kettlebell device shown in FIG. 1 with a handle removed therefrom.

Additionally or alternatively, the stop mechanism can be provided by a sleeve 124 removably disposed on the post 106. In this scenario, the sleeve 124 has a height 204 that is shorter or smaller than the height 206 of the post 106 and a diameter 208 that is larger than the diameter(s) 210 of the post 106, as shown in FIG. 2. Accordingly, a lip 106 is provided on which the handle can rest when coupled to the post 106.

In some scenarios, the stop mechanism can also be provided by a structure other than the post or sleeve. For example, a hollow ring can be slid over the post until a part thereof securely engages the post (e.g., a resiliently biased pin is inserted into a aperture formed in the post), whereby the handle is structurally supported by the ring.

Figure 6:
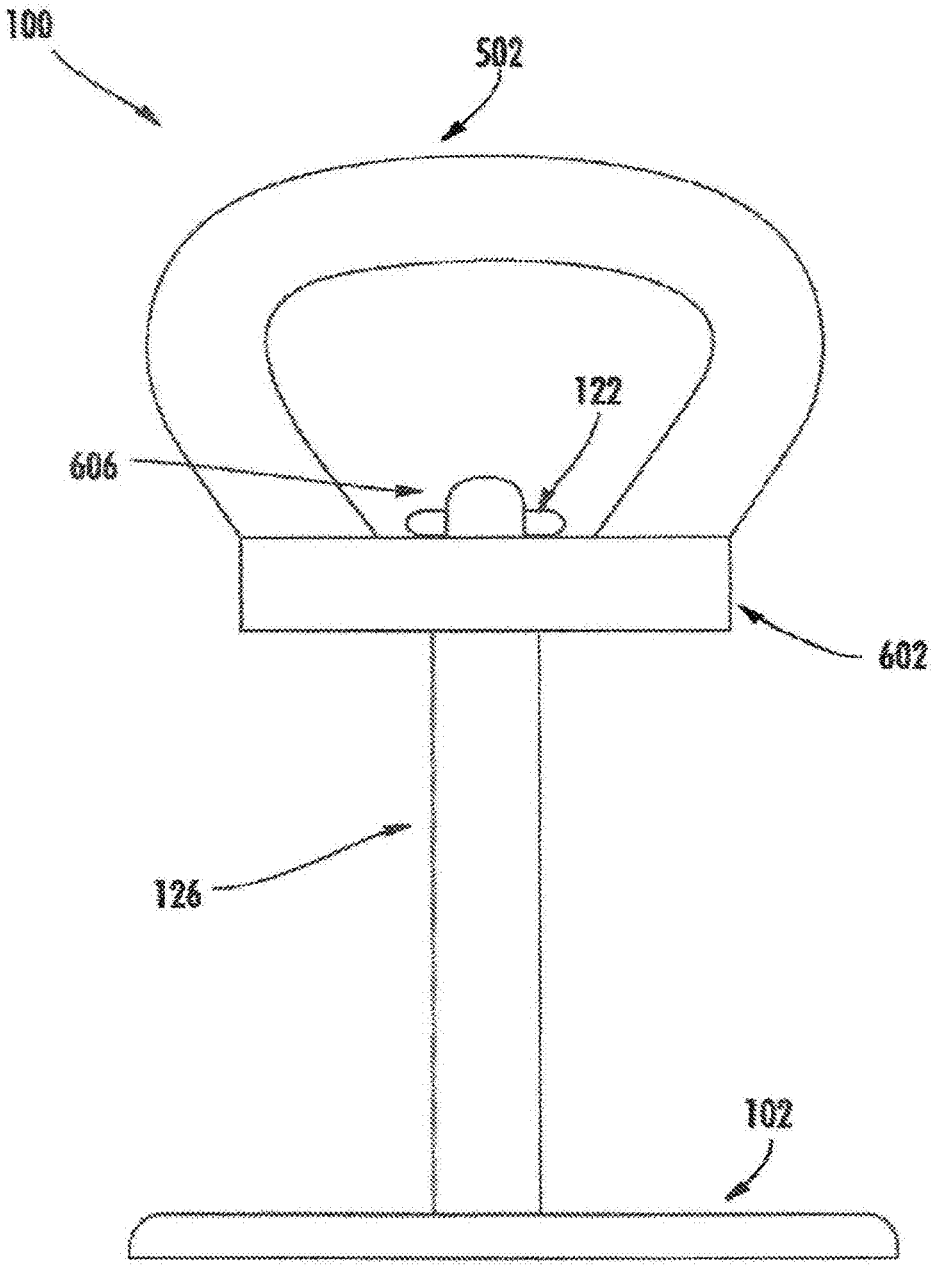
FIG. 6 provides a side view of an adjustable kettlebell device with a block handle and sleeves.
Figure 7:
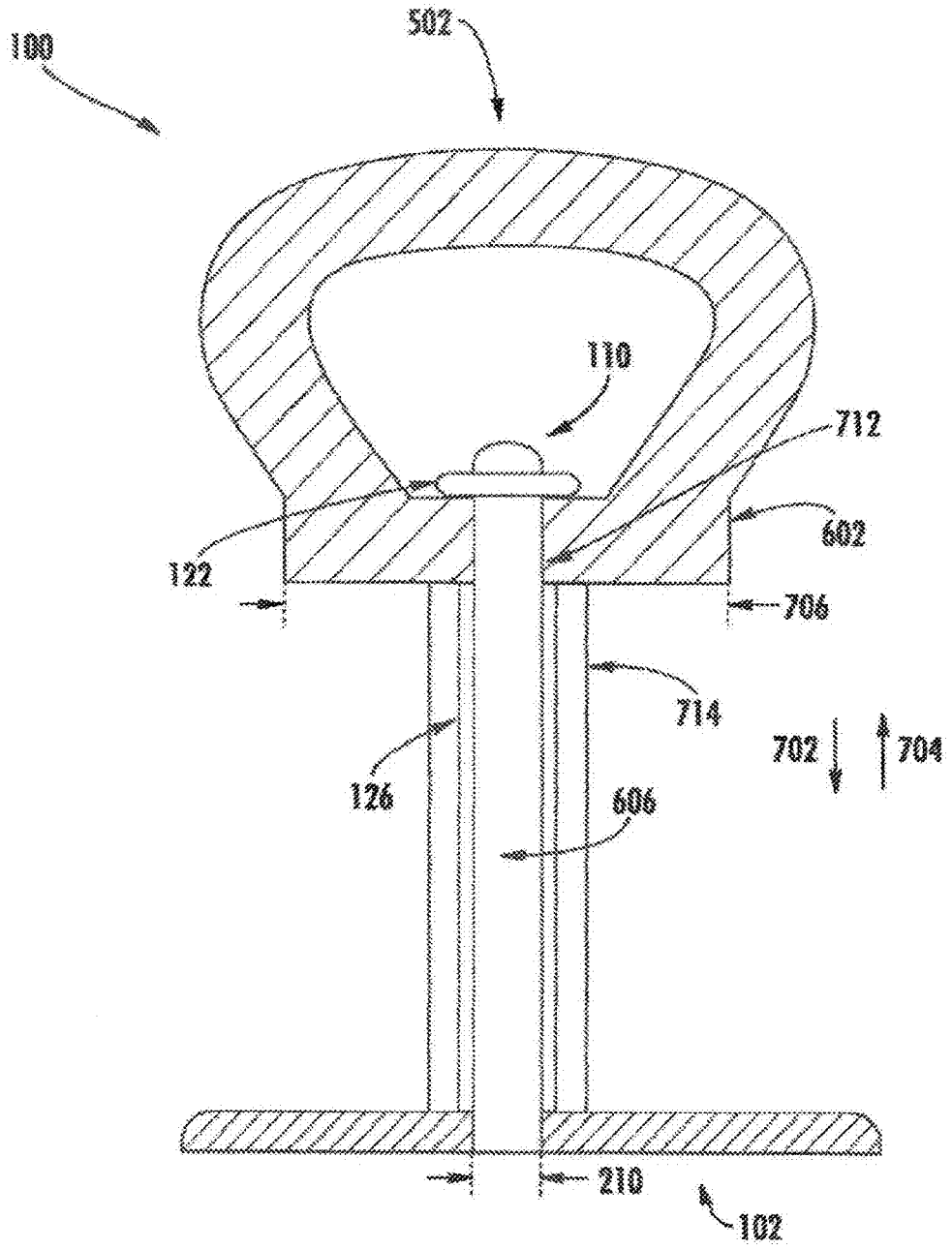
FIG. 7 provides a cross-sectional view of the adjustable kettlebell device shown in FIG. 6.

With reference to FIGS. 6-7, a handle is removed from the post 606 when weight plates are to be added to or removed from the adjustable kettlebell device 100. As noted above, a plurality of interchangeable handles may be provided with the adjustable kettlebell device 100. One such interchangeable handle is a block handle 504. The block handle 504 is shown in FIGS. 6-7 rather than the kettle handle 104 for illustrating the interchangeability of the handles. Accordingly, the following discussion will reference block handle 504 instead of kettle handle 104.

In order to add a weight plate to the adjustable kettlebell device 100, the weight plate is placed in position by lowering the center aperture thereof over the top of the post 606 and sliding in a downward direction 702 along the post 606 and over the sleeves 126 and/or 124 until it abuts the base 102 or another weight plate already disposed on the post 606. In order to remove a weight plate from the adjustable kettlebell device 100, the weight plate is slid in an upward direction 704 along the post 606 and over the sleeves 126 and/or 124 until the post no longer extends through the weight plate's center aperture.

In the multi-weight plate scenarios, the weight plates are arranged along an elongate length of the post 606 potentially over one or more sleeves in a stacked configuration. The weight plates are supported by the base 102 such that they are retained on the post 606 during use of the adjustable kettlebell device 100.

Notably, the handle 502 has a flange 602 with a width or diameter 706 greater than the width or diameter 210 of the post 606. The flange 602 ensures that the weight plate(s) is(are) retained on the post 606 when the handle 504 is secured to the post 106. In this way, the base 102, handle 502, post 606 and weight plate(s) becomes a unified adjustable kettlebell device that can be lifted, carried, swung or otherwise moved by a user thereof for exercise purposes.

The flange may be in the form of a cap that is a section of a sphere, as shown in FIG. 5 as 506, 508. Alternatively, both the flange and the block handle may be configured in an unlimited variety of dimensions and shapes, such as a spherical segment or frustum, rectangle, square, or the like. Such different dimensions and shapes may provide advantages for the user. For example, the use of a rectangular flange may reduce the size and weight of the handle, and thus of the assembled kettlebell. This may enhance the functionality of the handle in at least three ways: i) by reducing the total weight of the device so as to allow exercises and movements beginning with a lower starting weight without using any weight plates; ii) by reducing the overall height of the assembled kettlebell device, it may be more accessible to some individuals; and iii) the overall size or width of the handle may be reduced, which may reduce friction of the handle in the hand during certain exercises or movements. Other benefits may derive from a handle configured with different dimensions and designs than those disclosed herein. Because the solution provided do not limit the size and shape of the flange or the block handle, such benefits may be considered within the scope of this solution.

As noted above, weight plates can have center apertures with different sized diameters. For example, a first type of weight plates have center apertures with 1 inch diameters, while a second type of weight plates have center apertures with 2 inch diameters. In order to accommodate different sized weight plate apertures, the adjustable kettlebell device 100 is provided with: (A) a post with an outer diameter that allows the adjustable kettlebell device to be compatible with weight plates of a first type (e.g., standard weight plates) and a sleeve with a larger outer diameter that allows the adjustable kettlebell device to be compatible with weight plates of a second type (e.g., Olympic weight plates); or (B) a first sleeve for the post with an outer diameter that allows the adjustable kettlebell device to be compatible with the weight plates of the first type (e.g., standard weight plates) and a second sleeve with a larger outer diameter that allows the adjustable kettlebell device to be compatible with the weight plates of the second type (e.g., Olympic weight plates). The sleeves can be formed of any suitable materials such as plastic, metal or a composite material.

In scenario (B), the sleeves are each designed with center hollow through holes 712 having the same diameter as or a slightly larger diameter than the diameter 210 of the post 606. In other scenarios, the sleeves are concentric tubular parts with center hollow through holes having different diameters such that they can slide into or over each other. As shown in FIG. 7, the larger sleeve 714 completely surrounds the smaller sleeves 126 when both are disposed on the post 606. Both sleeves abut the flange 602 of the handle 504 at one end and abut the base 102 at the other end when the adjustable kettlebell device 100 is fully assembled. In all scenarios, the sleeves are designed to prevent lateral movement of one or more weights disposed thereon and/or structurally support the handle 504 from below (e.g., similar to a pillar).

Notably, the sleeve(s) 126, 714 eliminate(s) the need for proprietary weight plates in order to use the adjustable kettlebell device 100. In this regard, the present solution can be used with standard weight plates, Olympic weight plates and/or proprietary weight plates for the present or other exercise equipment. For example, in some scenarios, the first sleeve 126 has an outer diameter of 1 inch for accommodating standard weight plates, while the second sleeve 714 has an outer diameter of 2 inches for accommodating Olympic weight plates. The present solution is not limited in this regard.

At least one clamp (shown in FIG. 18) can be provided with the adjustable kettle bell device 100 to prevent vertical movement of the weight plates during use thereof. The clamp grips onto the post 106 or sleeve 714 so as to prevent one or more weights from sliding along the post or sleeve while the adjustable kettlebell device 100 is in motion (e.g., a swinging motion).

Referring now to FIGS. 11-17, there are provided illustrations that are useful for understanding how weights are added to and removed from an adjustable kettlebell device 1100 in accordance with the present solution. Adjustable kettlebell device 1100 is the same as or similar to adjustable kettlebell device 100. As such, the discussion provided above in relation to adjustable kettlebell device 100 is sufficient for understanding adjustable kettlebell device 1100.

Like adjustable kettlebell device 100, the adjustable kettlebell device 1100 comprises a handle 1102, a base 1104, and a post 1106 coupled to the base 1104 (e.g., via a weld). In this scenario, the post has one diameter along its entire length. The handle 1102 has a through hole 1112 formed therein. The through hole 1112 is sized and shaped to receive post 1106. Post 1106 also has a through hole 1114 formed therein. Through hole 1114 is sized and shaped to receive pin 1116 for coupling the handle 1102 to the post 1106.

Post 1106 may have a diameter selected to accommodate various types and sizes of weight plates. One or more sleeves 1108, 1110 may also be provided to accommodate other types of weight plates. For example, post 1106 is configured to accommodate weight plates of conventional exercise equipment, and therefore has an outer diameter less than three quarters of an inch. Sleeve 1108 is configured to accommodate standard weight plates 1300, and therefore has an outer diameter of one inch. Sleeve 1110 is configured to accommodate Olympic weight plates, and therefore has an outer diameter of two inches. The present solution is not limited to the particulars of this example. In other scenarios, the post 1106 may not be configured to be used with any type of weight plate. In still other scenarios, sleeves 1108 and 1110 can be configured with varied outer and inner diameters depending on the application and may or may not be used in the nesting configuration described herein with sleeves 1110 sliding over sleeve 1108. For example, sleeve 1110 may have a two inch outer diameter but a smaller inner diameter that allows it to fit snugly, directly onto post 1106 without the use of sleeve 1108.

Figure 12:
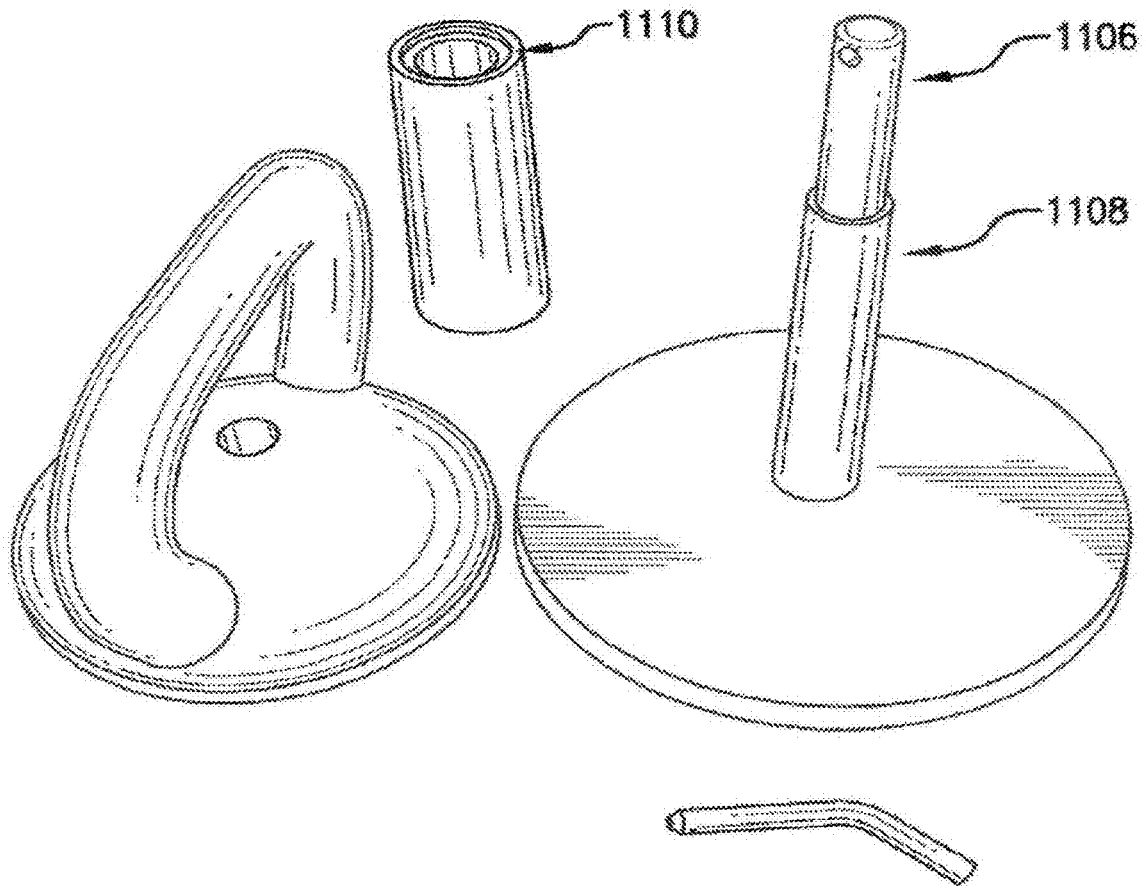
FIG. 12 provides an illustration of the adjustable kettlebell device shown in FIG. 11 with a sleeve disposed on a post.
Figure 13:
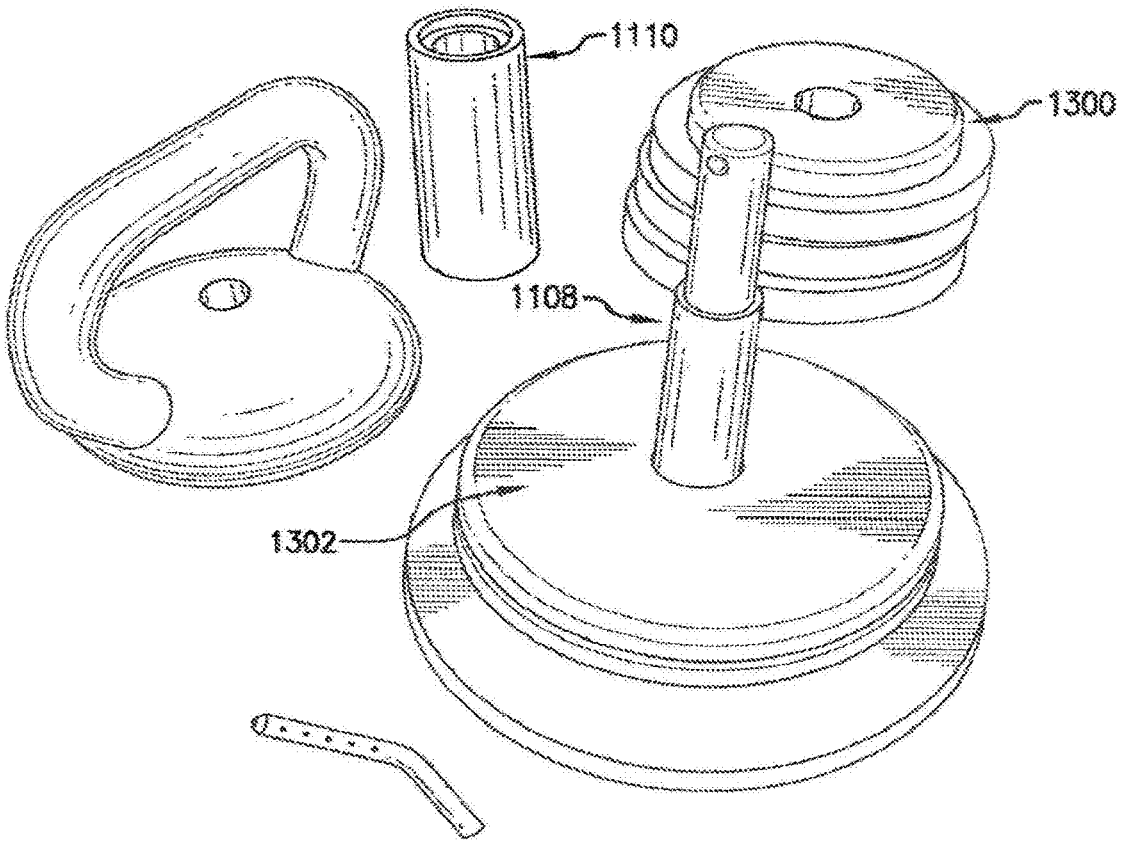
FIG. 13 provides an illustration of the adjustable kettlebell device shown in FIGS. 11-12 with weight plates disposed on the sleeve.
Figure 14:
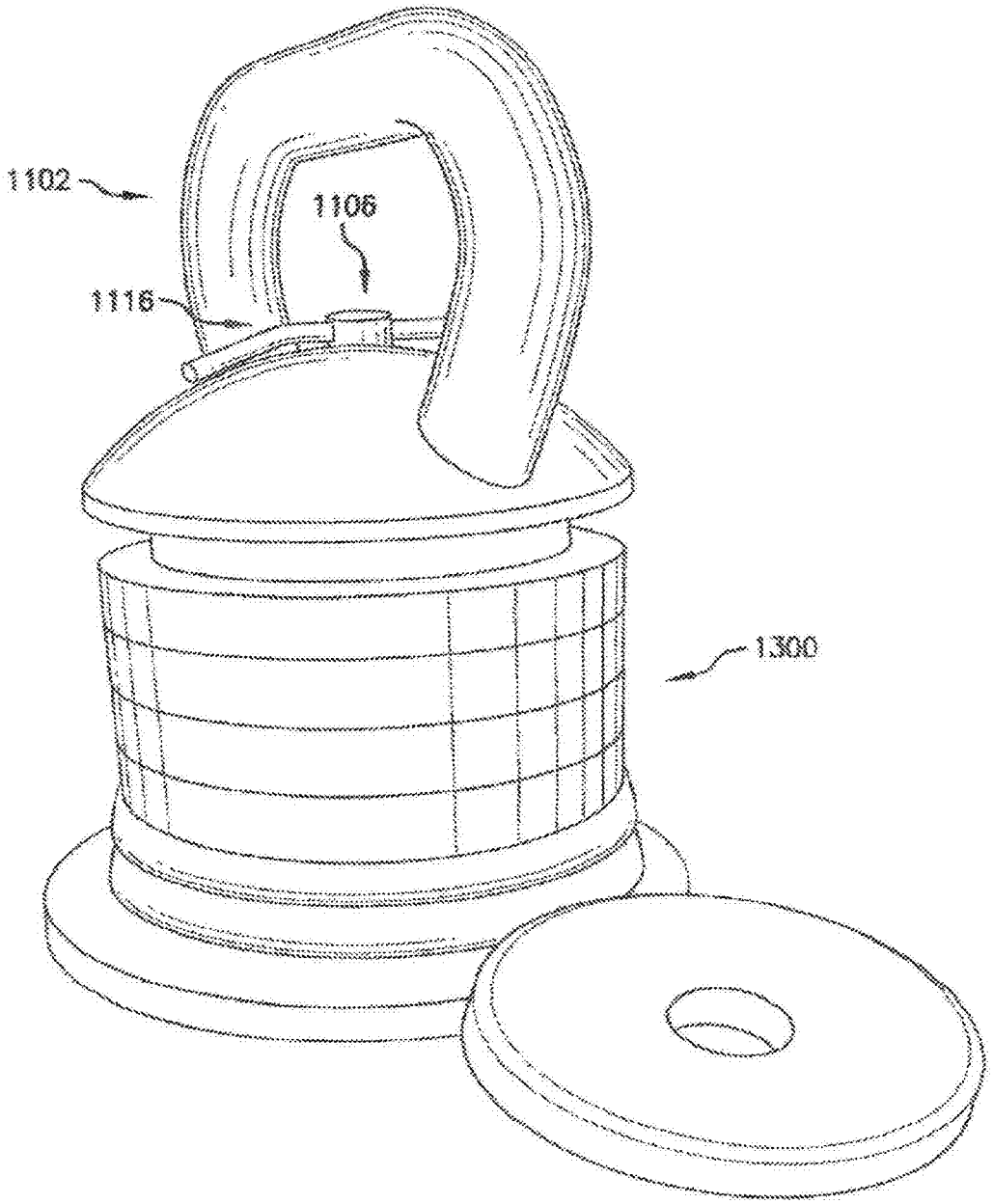
FIG. 14 provides an illustration of the adjustable kettlebell device shown in FIGS. 11-13 with weight plates disposed on the sleeve and a kettle handle coupled to the post.

As shown in FIG. 12, sleeve 1108 is configured to slide onto post 1106. Sleeve snugly fits on post 1106 such that it does not move horizontally relative to post 1106. One or more weight plates 1302 are then slid over sleeve 1108 as shown in FIG. 13. Next, the handle 1102 is securely coupled to the post 1106 via the pin 1116, as shown in FIG. 14.

Figure 15:
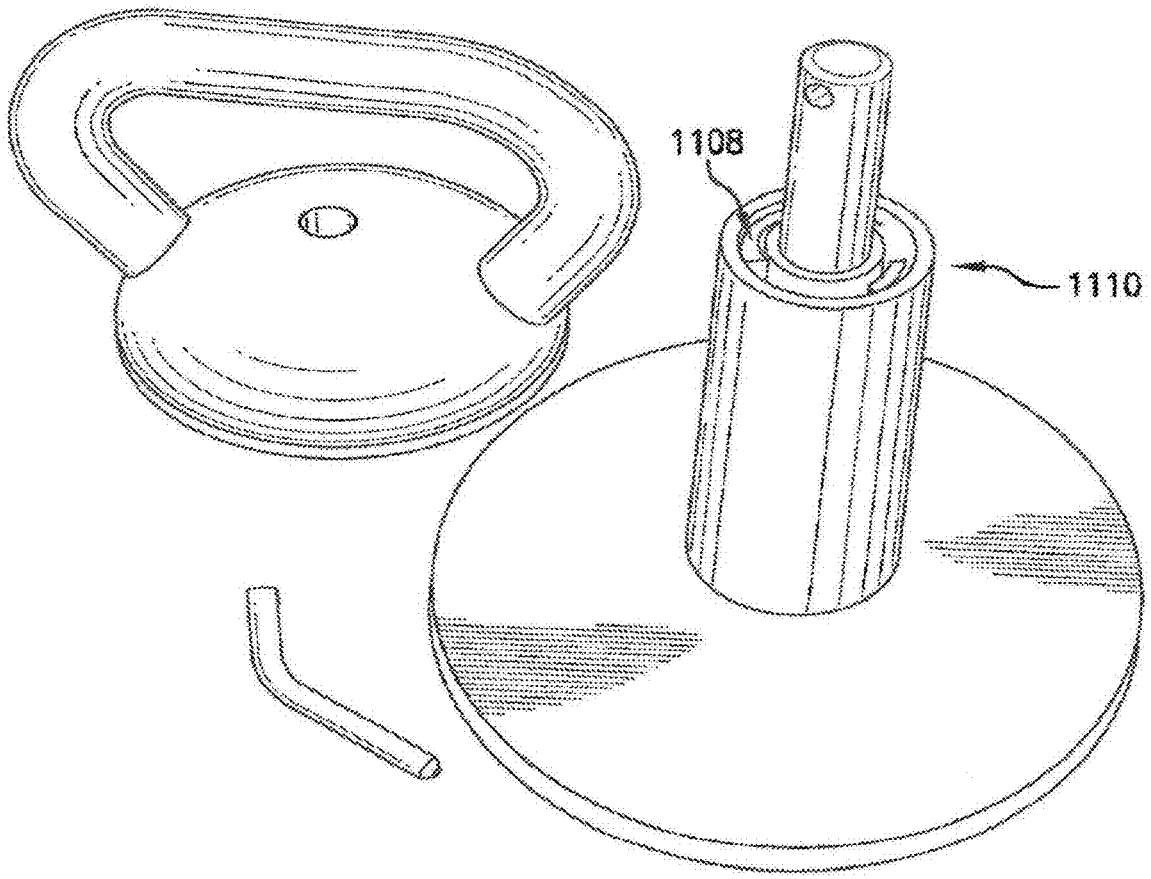
FIG. 15 provides an illustration of the adjustable kettlebell device shown in FIG. 11 with two sleeves disposed on the post.
Figure 16:
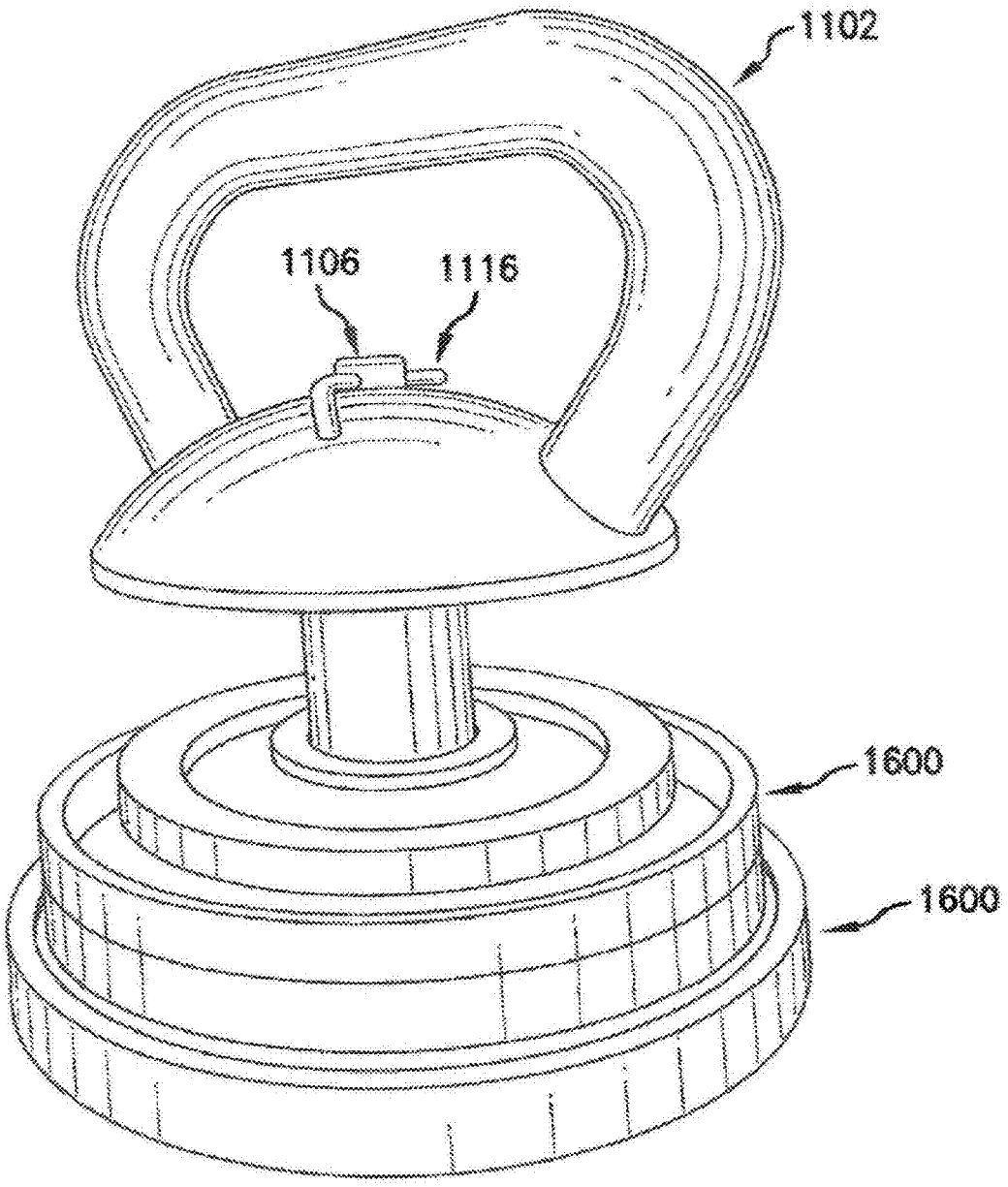
FIG. 16 provides an illustration of the adjustable kettlebell device shown in FIGS. 11-12 with weight plates disposed on the sleeves and the kettle handle coupled to the post.

If it is desirable to use a different type of weight plates, then the adjustable kettlebell device 1100 is disassembled and the weight plates 1300 are removed therefrom, as shown in FIG. 15. Also, the second sleeve 1110 is slid over the first sleeve 1108. Sleeve 1110 has an inner diameter that allows it to fit onto sleeve 1108 such that it does not move horizontally relative to sleeve 1108 and/or post 1106. One or more weight plates 1600 are then slid over sleeve 1110 as shown in FIG. 16. Notably, the weight plates 1600 have through holes or center apertures with diameters greater than the diameters of the through holes or center apertures of weight plates 1300. Next, the handle 1102 is securely coupled to the post 1106 via the pin 1116, as also shown in FIG. 16.

Figure 17:
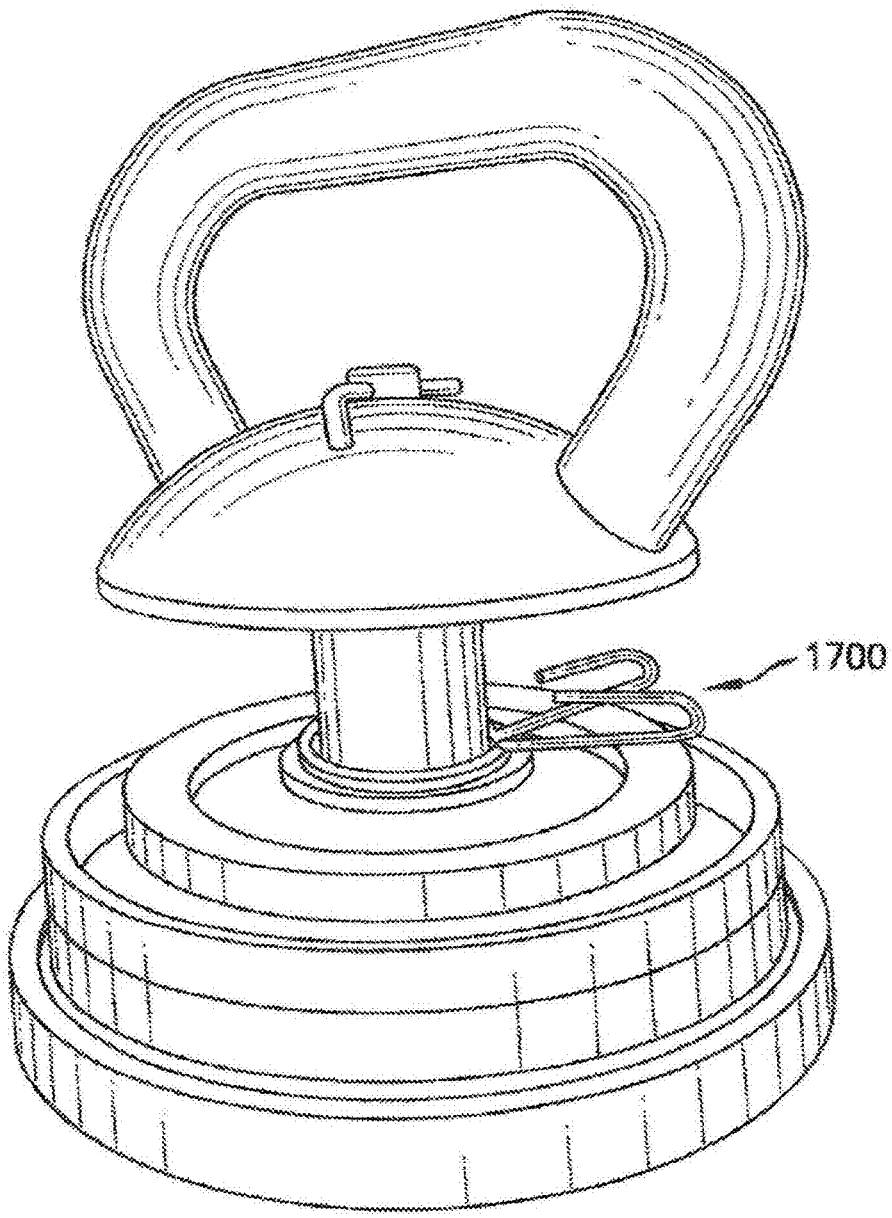
FIG. 17 provides an illustration showing the adjustable kettlebell device of FIG. 16 with an illustrative clamp coupled to the sleeve above the weight plates.

A clamp mechanism 1700 is coupled to the sleeve 1110 as shown in FIG. 17. The clamp mechanism 1700 ensures that the weight plates 1600 do not move relative to the post 1106 and sleeves 1108, 1110 when the adjustable kettlebell device 1100 is in use. Notably, the clamp mechanism 1700 is an optional component and is not necessary in certain scenarios such as those where the weight plates stack up to cover the full length (or height) of the sleeve 1110 (and are therefore secured by the handle 1102 and base 1104).

Figure 18:
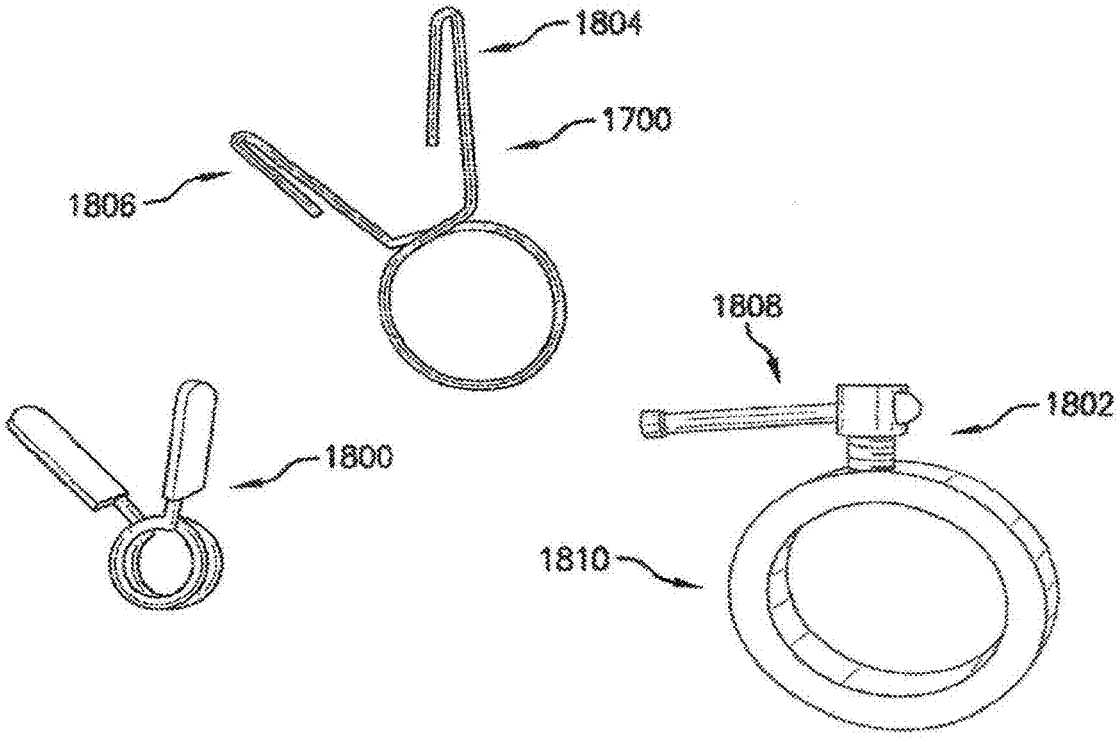
FIG. 18 provide illustrations of various illustrative clamps.
Figure 19:
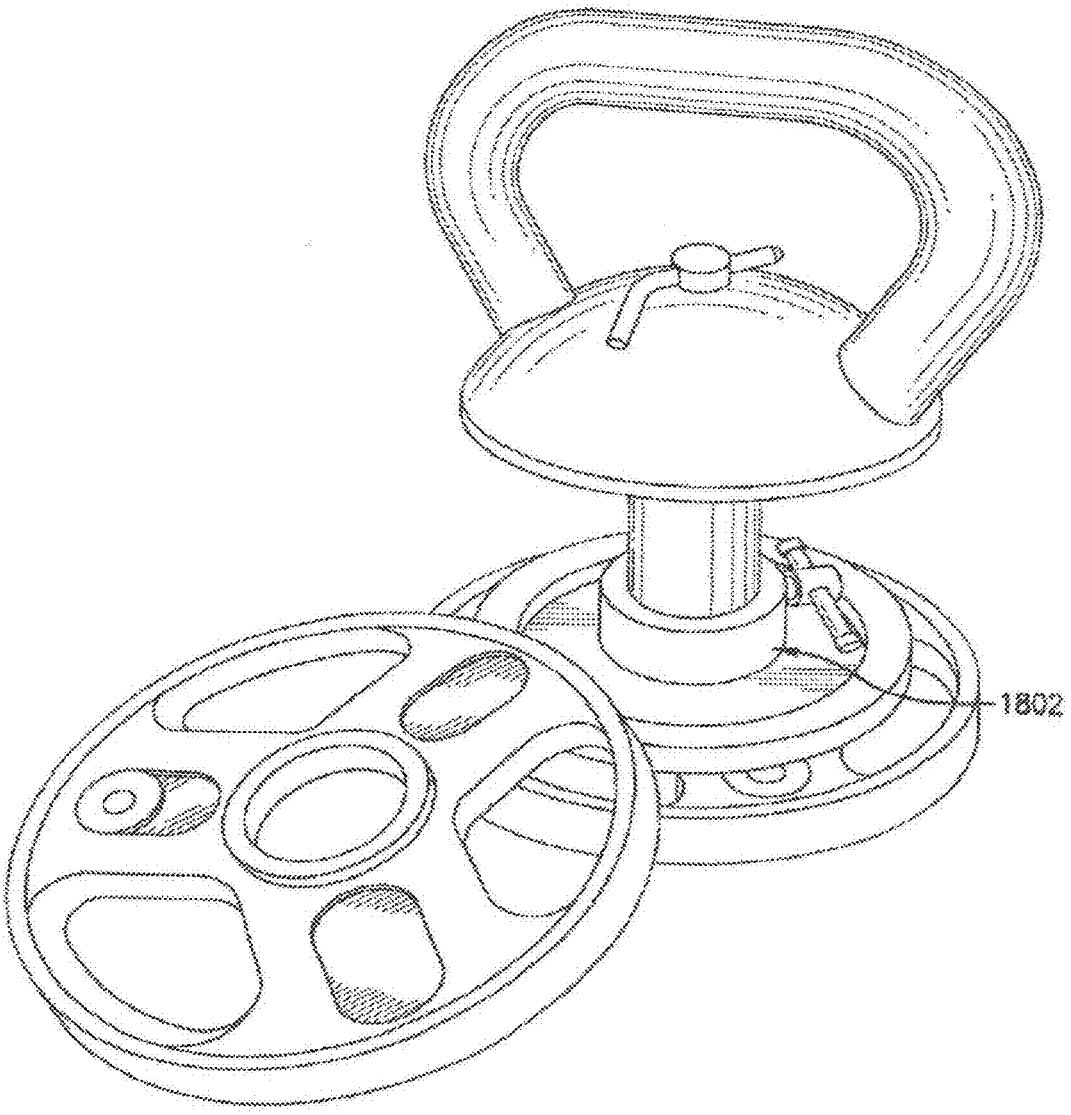
FIG. 19 provides an illustration showing the adjustable kettlebell device with another illustrative clamp coupled to the sleeve above a weight plate.

The present solution is not limited to the clamp mechanism design shown in FIG. 17. Other clamp mechanism designs 1800, 1802 are shown in FIG. 18. Clamp mechanisms 1700, 1800 are designed to: (a) have a variable inner diameter; (b) be slid over the post 1106 and/or sleeve(s) 1108, 1110; and (c) apply a clamping force on the post 1106 and/or sleeve(s) 1108, 1110. In this regard, the clamp mechanisms 1700, 1800 each have two protruding portions 1804, 1806 that can be pressed towards each other so as to enlarge the inner diameter thereof. The inner diameter is decreased simply by releasing the two protruding portions 1804, 1806. In contrast, the clamp mechanism 1802 is designed to: (a) have a static inner diameter; (b) be slid over the post 1106 and/or sleeve(s) 1108, 1110; and (c) apply a clamping force on the post 1106 and/or sleeve(s) 1108, 1110. In this regard, the clamp mechanism 1802 has a screw part 1808 that can be tightened by rotation in a first direction (e.g., a clockwise direction). When tightened, the post 1106 and/or sleeve(s) 1108, 1110 is(are) clamped between the screw part 1808 and a ring part 1810. The post 1106 and/or sleeve(s) 1108, 1110 are released simply by rotating the rotatable screw part 1808 in a second direction opposed from the first direction (e.g., a counter clockwise direction). An illustration showing the clamp mechanism 1802 in use is provided in FIG. 19.

Figure 31:
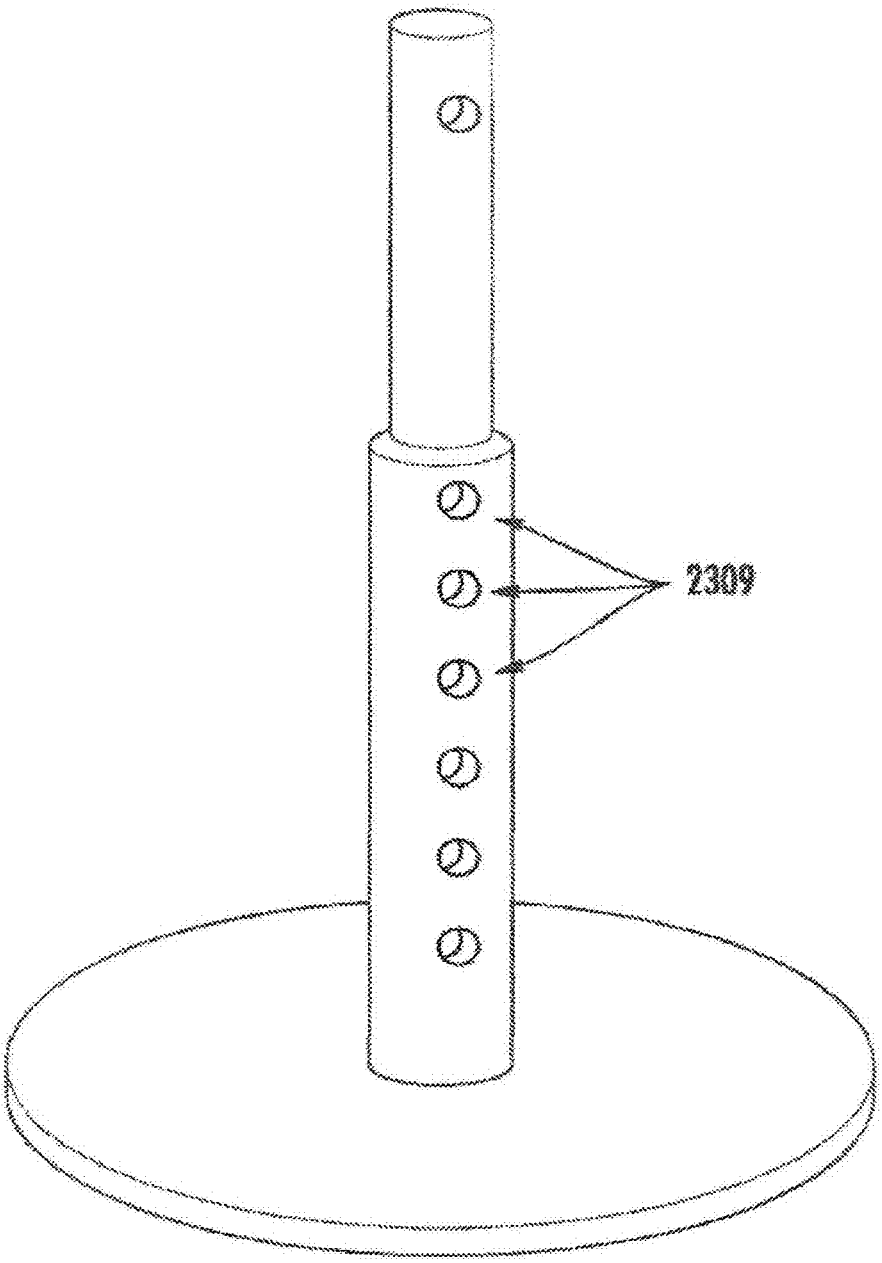
FIG. 31 provides an illustration showing another illustrative post.

The present solution is not limited to clamp mechanisms. In some scenarios, the post and/or sleeve has a plurality of apertures 2309 formed therethrough as shown in FIG. 31. The apertures 2309 are sized and shaped to receive a pin for securing the weights in a given position relative to the handle. This configuration of the vertical post of the adjustable kettlebell device allows for the use of multiple horizontal through-holes placed at different heights. The through-holes may be spaced equally along the height of the post, or the space between them may varied. Further, the through-holes may be aligned vertically up and down as shown in FIG. 31, or may be configured to pass through on different vertical planes. For example, holes may be placed 0.25" apart vertically, and adjacent holes may have centers that pass through the central axis of the post at 30° intervals. Of course, other vertical distances and angular intervals may be used between the through-holes without departing from the scope of the solution.

The use of such through-holes allow a user to slide weight plates onto the post and secure them by inserting a selector or weight pin or the like through the appropriate through-hole i.e., the hole closest vertically to the top of last weight plate. This may obviate the need for a clamp or other securing device to be placed on the vertical post to hold the weights in place. This may reduce the time and effort needed to change plates and reconfigure the adjustable kettlebell device.

Referring now to FIGS. 23-30, there are provided illustrations that are useful for understanding how weights are added to and removed from an adjustable kettlebell device 2300 in accordance with the present solution. Adjustable kettlebell device 2300 is the same as or similar to adjustable kettlebell device 100. As such, the discussion provided above in relation to adjustable kettlebell device 100 is sufficient for understanding adjustable kettlebell device 2300.

Like adjustable kettlebell device 100, the adjustable kettlebell device 2300 comprises a handle 2304, a base 2302, and a post 2306 coupled to the base 2302 (e.g., via a weld). Notably, in this scenario, the post is a multi-diameter post (i.e., a post with a lower portion 2310 having a first diameter greater than the diameter of an upper portion 2311). The multi-diameter post is also depicted in FIGS. 8-9. The handle 2304 has a through hole 2308 formed therein. The through hole 2308 is sized and shaped to slide over post 2306. Post 2306 also has a through hole 2314 formed therein. Through hole 2314 is sized and shaped to receive pin 2312 for coupling the handle 2304 to the post 2306.

Figure 24:
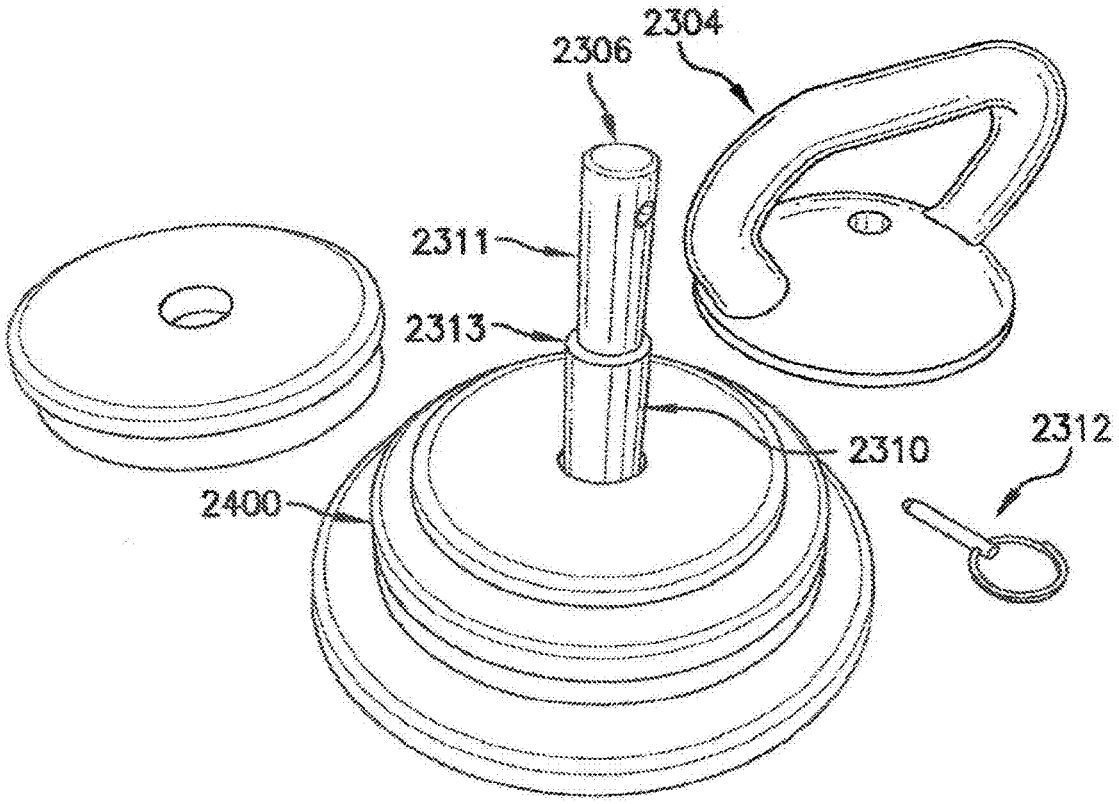
FIG. 24 provides an illustration of the adjustable kettlebell device shown in FIG. 23 with weights disposed on the multi-diameter post.
Figure 25:
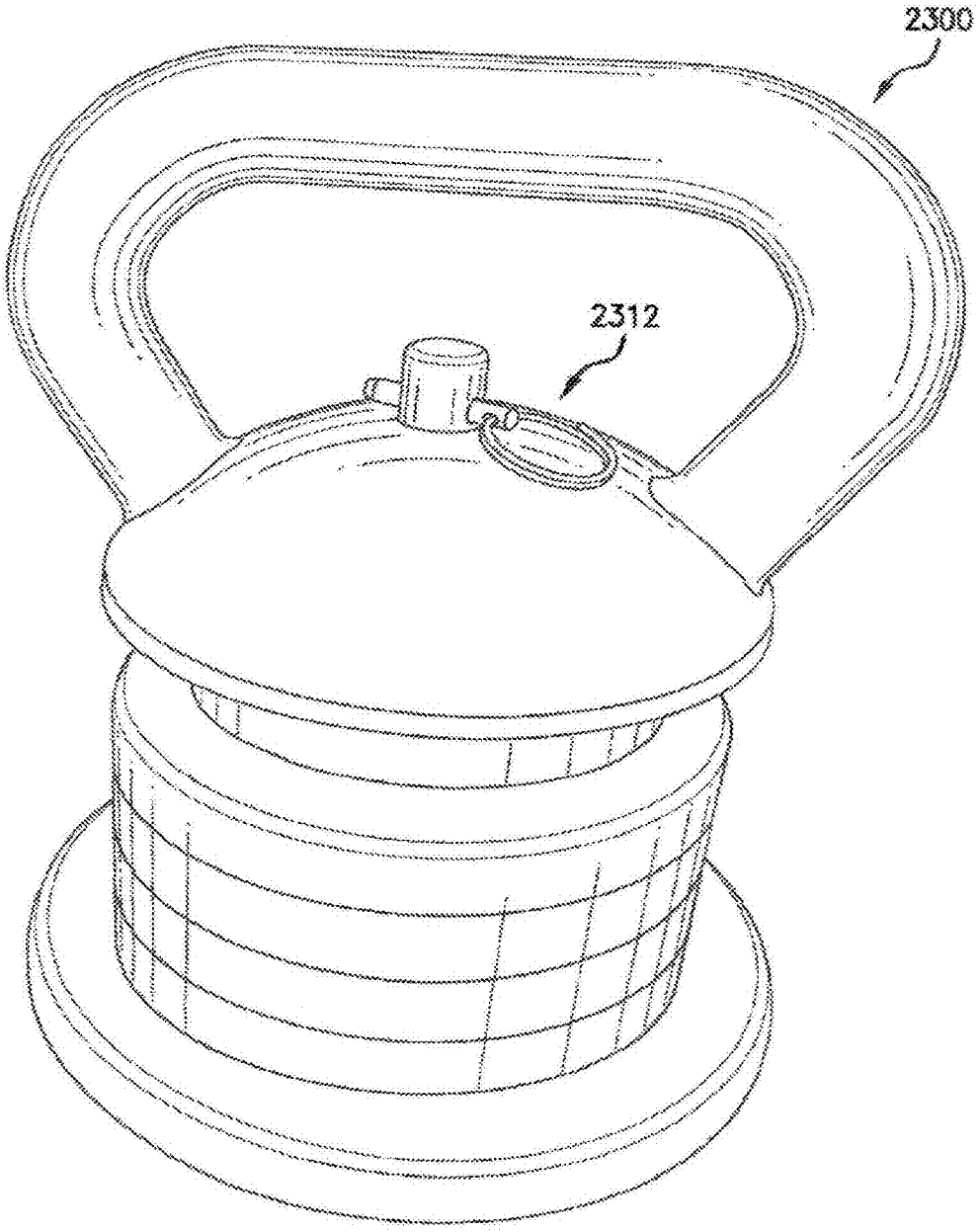
FIG. 25 provides an illustration of the adjustable kettlebell device shown in FIGS. 23-24 with the kettle handle coupled to the multi-diameter post.

Post 2306 may have a lower portion with a diameter to accommodate a particular type of weight plate (e.g., standard weight plates). Accordingly during use, one or more weight plates 2400 are slid over the lower portion 2310 of post 2306 as shown in FIG. 24. Weight plates 2400 snugly fit on the wider, lower portion 2310 of post 2306 such that they do not move horizontally relative to post 2306. Next, the handle 2304 is slid over the narrower upper portion 2311 of the post 2306 so that it comes to rest on the lip or ledge 2313 formed by the larger diameter of the lower portion 2310 of post 2306 and the handle is thereby securely supported by the wider, lower portion of the post. The final assembly of the handle 2304 to post 2306 is illustrated in FIGS. 25-26.

Figure 26:
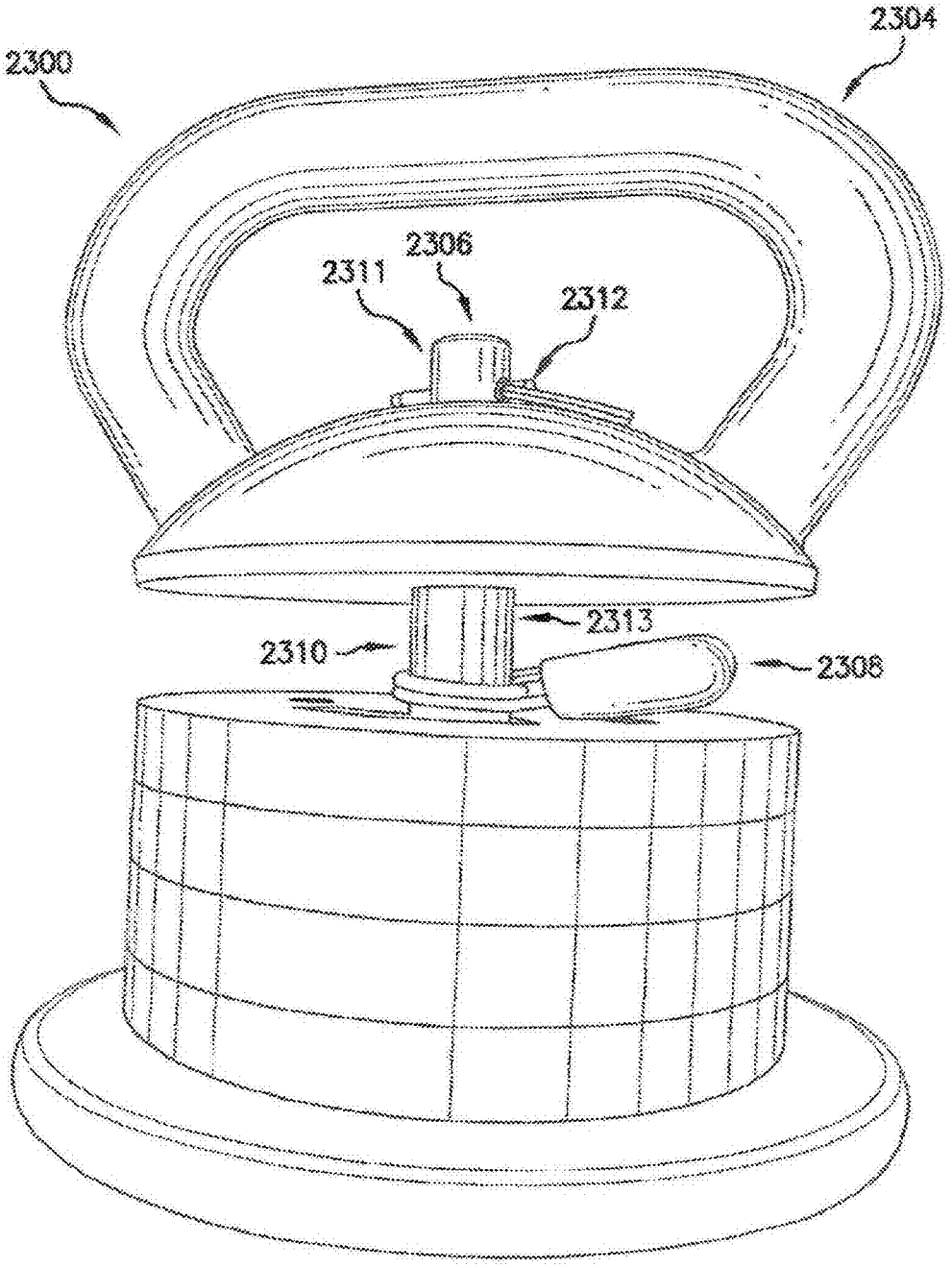
FIG. 26 provides an illustration of the adjustable kettlebell device shown in FIGS. 23-25 with a clamp coupled to the multi-diameter post.

FIG. 26 shows the handle 2304 resting on the ledge or pillar 2313 formed by the wider diameter, lower portion 2310 of post 2306. The handle 2304 is securely coupled to post 2306 via the pin 2312, as shown in FIG. 25. A clamp 2309 may also be coupled to the post as shown in FIG. 26.

Figure 27:
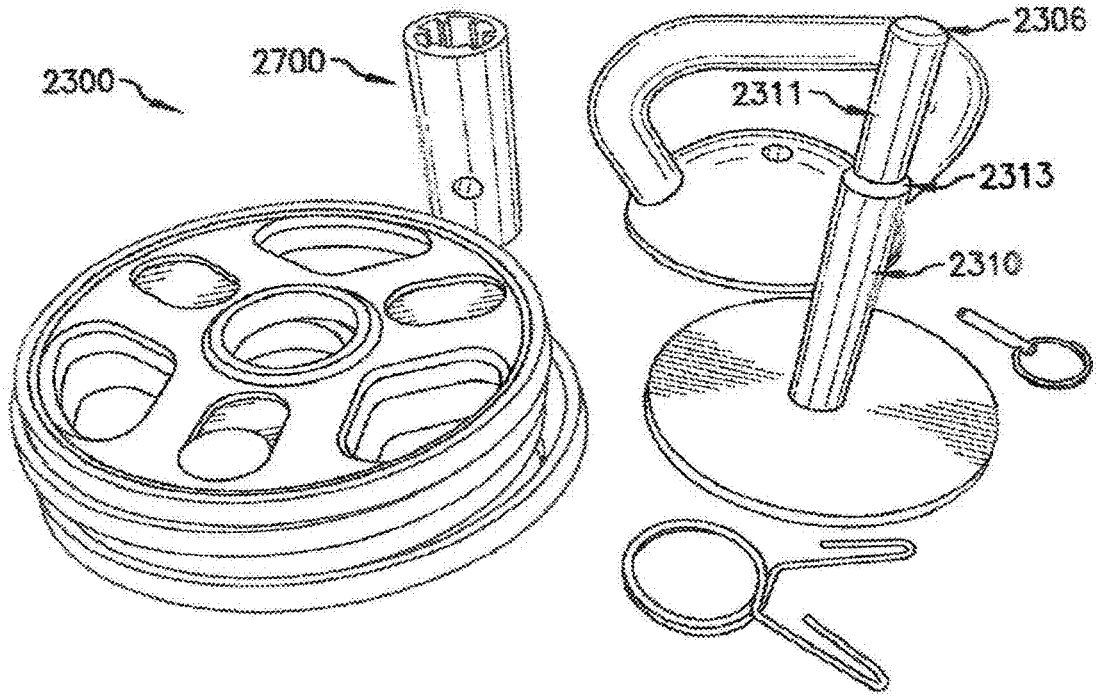
FIG. 27 provides an illustration of an adjustable kettlebell device provided in a dissembled state provided with an optional sleeve.

If it is desirable to use a different type of weight plates, then the adjustable kettlebell device 2300 is quickly and easily disassembled and the weight plates 2400 are removed therefrom. As shown in FIG. 27, it should be understood that one or more sleeves 2700 may be provided to accommodate other types of weight plates (e.g., Olympic weight plates).

Figure 28:
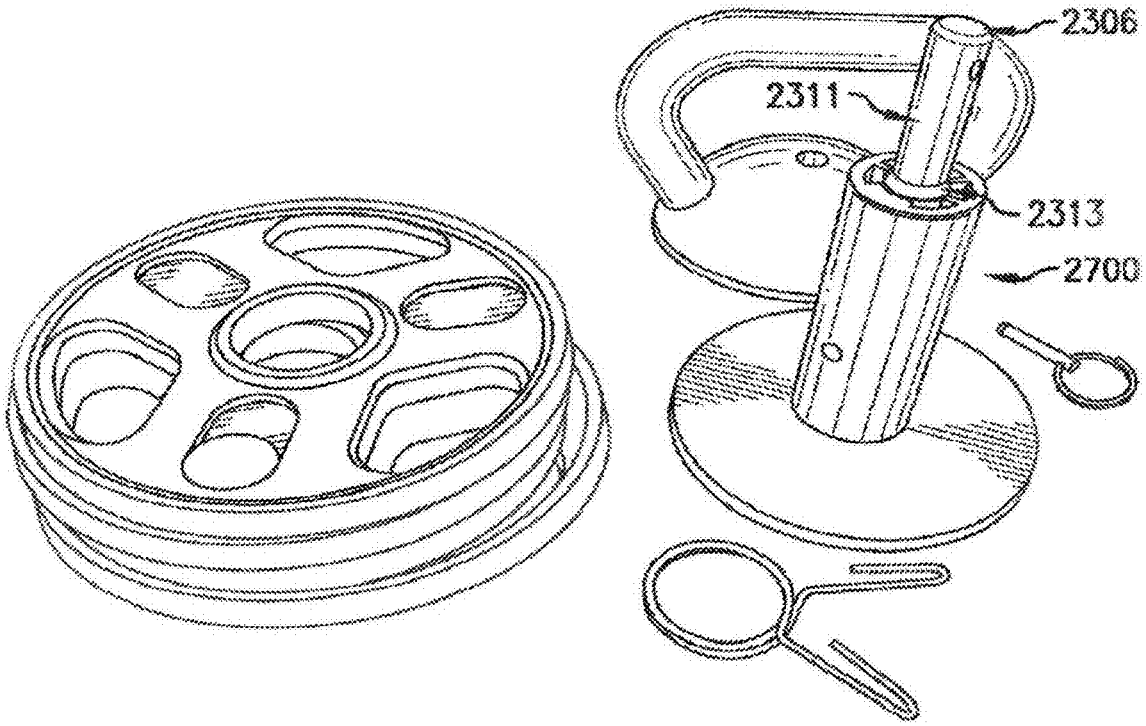
FIG. 28 provides an illustration of the adjustable kettlebell device shown in FIG. 27 with the sleeve disposed on the multi-diameter post.
Figure 29:
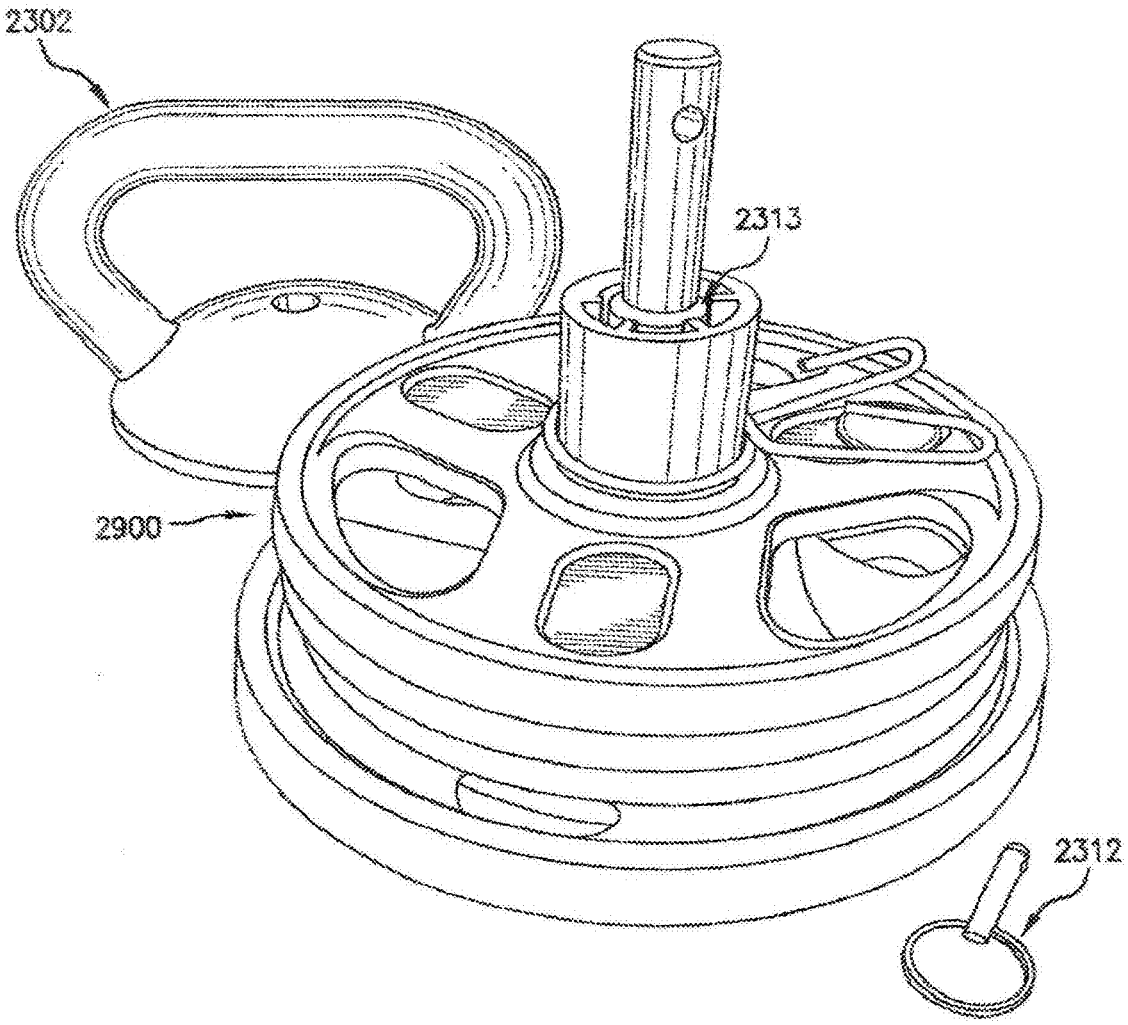
FIG. 29 provides an illustration of the adjustable kettlebell device shown in FIGS. 27-28 with weight disposed on the sleeve and a clamp coupled to the sleeve.
Figure 30:
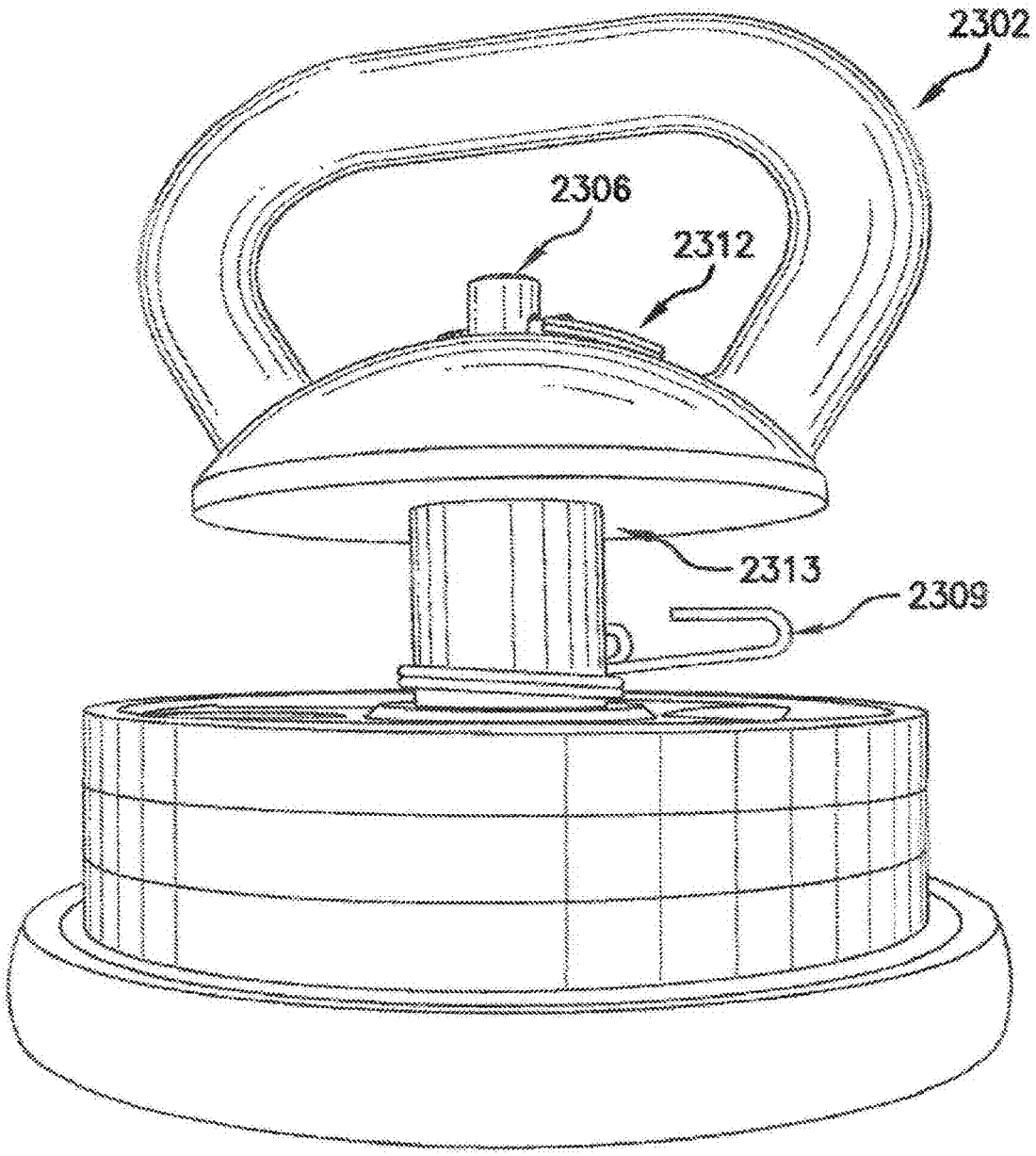
FIG. 30 provides an illustration showing the adjustable kettlebell device of FIGS. 27-29 with a handle coupled to the multi-diameter post.

As shown in FIGS. 27-28, sleeve 2700 is configured to slide onto post 2306. Sleeve snugly fits on the lower, wider diameter portion 2310 of post 2306 such that it does not move horizontally relative to post 2306. One or more weight plates 2900 are then slid over sleeve 2700 as shown in FIG. 29. Next, the handle 2304 is slid over upper portion 2311 of post 2306 so that it comes to rest on the lip or ledge 2313 formed by the larger diameter of sleeve 2700 which creates a kind of pillar or platform which securely supports handle 2304 from below. The final assembly of the handle 2304 in relation to sleeve 2700 is illustrated in FIGS. 29 and 30. Finally, the handle 2304 is securely coupled to the post 2306 via the pin 2312, as shown in FIG. 30. The clamp 2309 may be coupled to the sleeve as also shown in FIG. 30.

Illustrative Methods For Using Adjustable Kettlebell Devices

Figure 3:
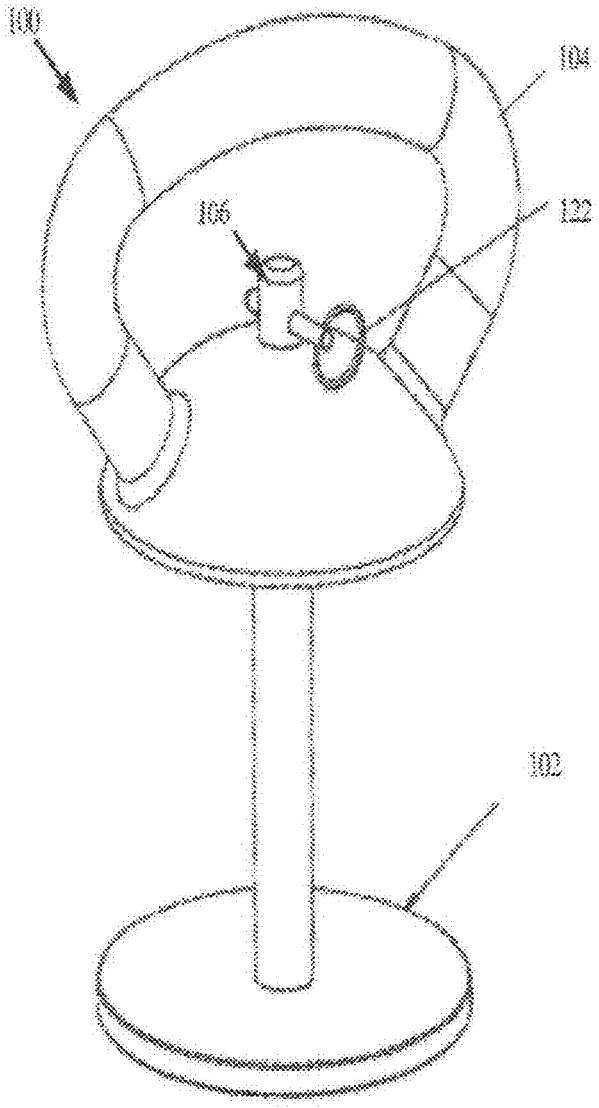
FIG. 3 is a perspective view of the adjustable kettlebell device shown in FIG. 1 with a sleeve removed therefrom.
Figure 4:
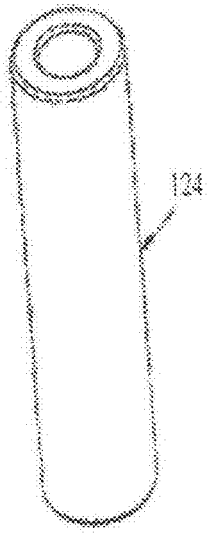
FIG. 4 is a perspective view of a sleeve.
Figure 20:
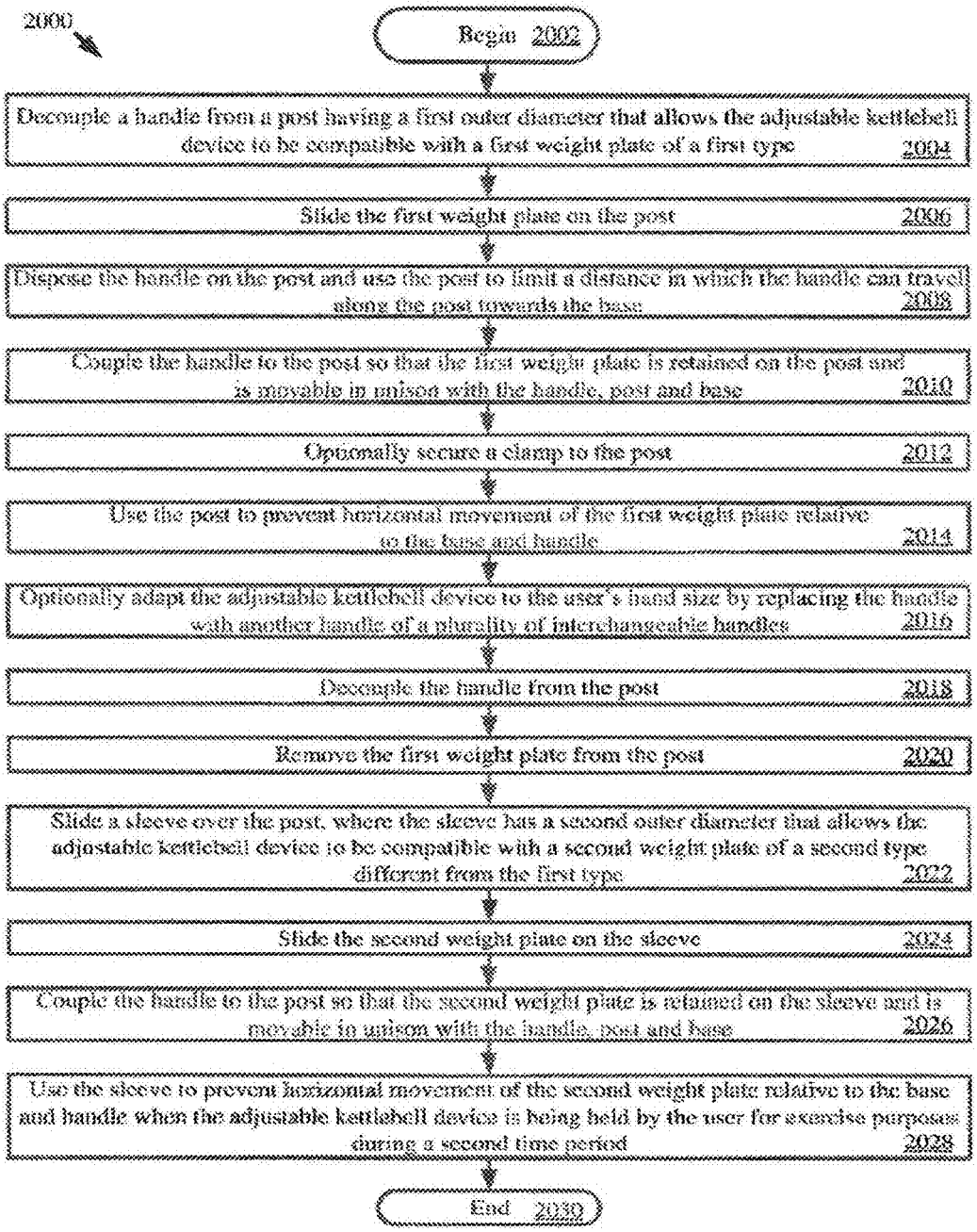
FIG. 20 is a flow diagram of an illustrative method for using an adjustable kettlebell device.
Figure 23:
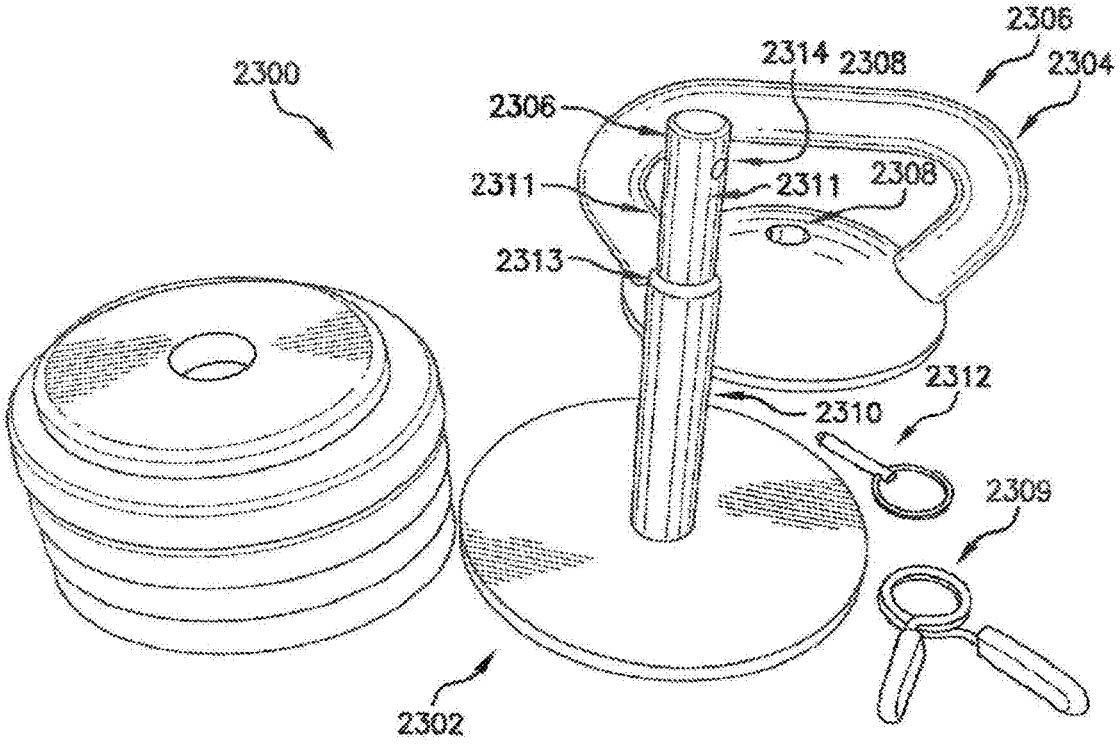
FIG. 23 provides an illustration of an illustrative adjustable kettlebell device with a multi-diameter post that is shown in a disassembled state.

Referring now to FIG. 20, there is provided a flow diagram of an illustrative method 2000 for using an adjustable kettlebell device (e.g., adjustable kettlebell device 100 of FIG. 1-3 and/or 2300 of FIGS. 22-23). Method 2000 begins with 2002 and continues with 2004 where a handle (e.g., handle 104 of FIG. 1 or handle 2304 of FIG. 23) is decoupled from a post (e.g., post 106 of FIG. 1 or post 2306 of FIG. 23). The post has a first outer diameter (e.g., diameter 2212 of FIG. 22 or 2310 of FIG. 23) that allows the adjustable kettlebell device to be compatible with a first weight plate (e.g., weight plate 2400 of FIG. 24) of a first type (e.g., a standard weight plate type). Next in 2006, the first weight plate is slid on the post.

The handle is then disposed on the post in 2008. The post is used to limit the distance in which the handle can travel along its elongate length towards a base (e.g., base 102 of FIG. 1). In this regard, the post has at least two portions with different diameters. For example, the post has an upper portion with a first diameter and a lower portion with a second diameter larger than the first diameter (e.g., FIGS. 22 and/or 23).

In 2010, the handle is coupled to the post so that the first weight plate is retained on the post and is movable in unison with the handle, post and base. Notably, the post is used to structurally support the handle and maintain the handle's position relative to the base.

A clamp may optionally be secured to the post as shown by 2012. The clamp is provided to prevent vertical movement of the first weight plate along an elongate length of the post during a first period of time when the adjustable kettlebell device is being used for exercise purposes.

In 2014, the post is used to prevent horizontal movement of the first weight plate relative to the base and handle when the adjustable kettlebell device is being held by a user for exercise purposes during the first time period. The adjustable kettlebell device is optionally adapted to the user's hand size (or for any of a number of other ergonomic or aesthetic reasons) in 2016 by replacing the handle with another handle of a plurality of interchangeable handles (e.g., interchangeable handles 104 of FIGS. 1 and/or 502-508 of FIG. 5).

Thereafter in 2018, the handle is decoupled from the post. The first weight plate is removed from the post in 2020. In 2022, a sleeve (e.g., sleeve 124 of FIGS. 1-2 and 4) is slid over the post. The sleeve has a second outer diameter (e.g., diameter 208 of FIG. 2) that allows the adjustable kettlebell device to be compatible with a second weight plate of a second type (e.g., an Olympic type) different from the first type. In 2024, the second weight plate is slid on the sleeve.

Thereafter in 2026, the handle is coupled to the post so that the second weight plate is retained on the sleeve and is movable in unison with the handle, post and base. In 2028, the sleeve is used to prevent horizontal movement of the second weight plate relative to the base and handle when the adjustable kettlebell device is being held by the user for exercise purposes during a second time period. Subsequently, 2030 is performed where method 2000 ends.

Figure 11:
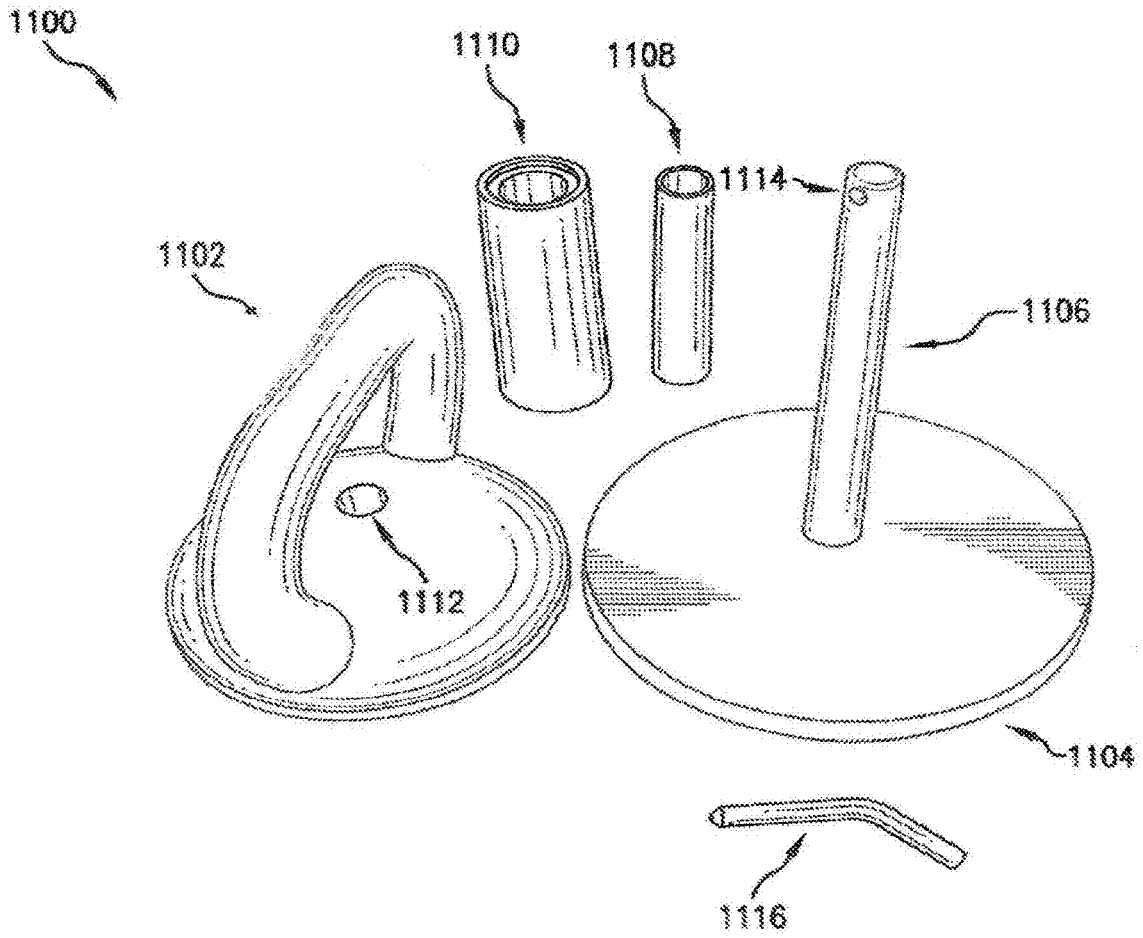
FIG. 11 provides an illustration of an illustrative adjustable kettlebell device in a disassembled state.
Figure 21:
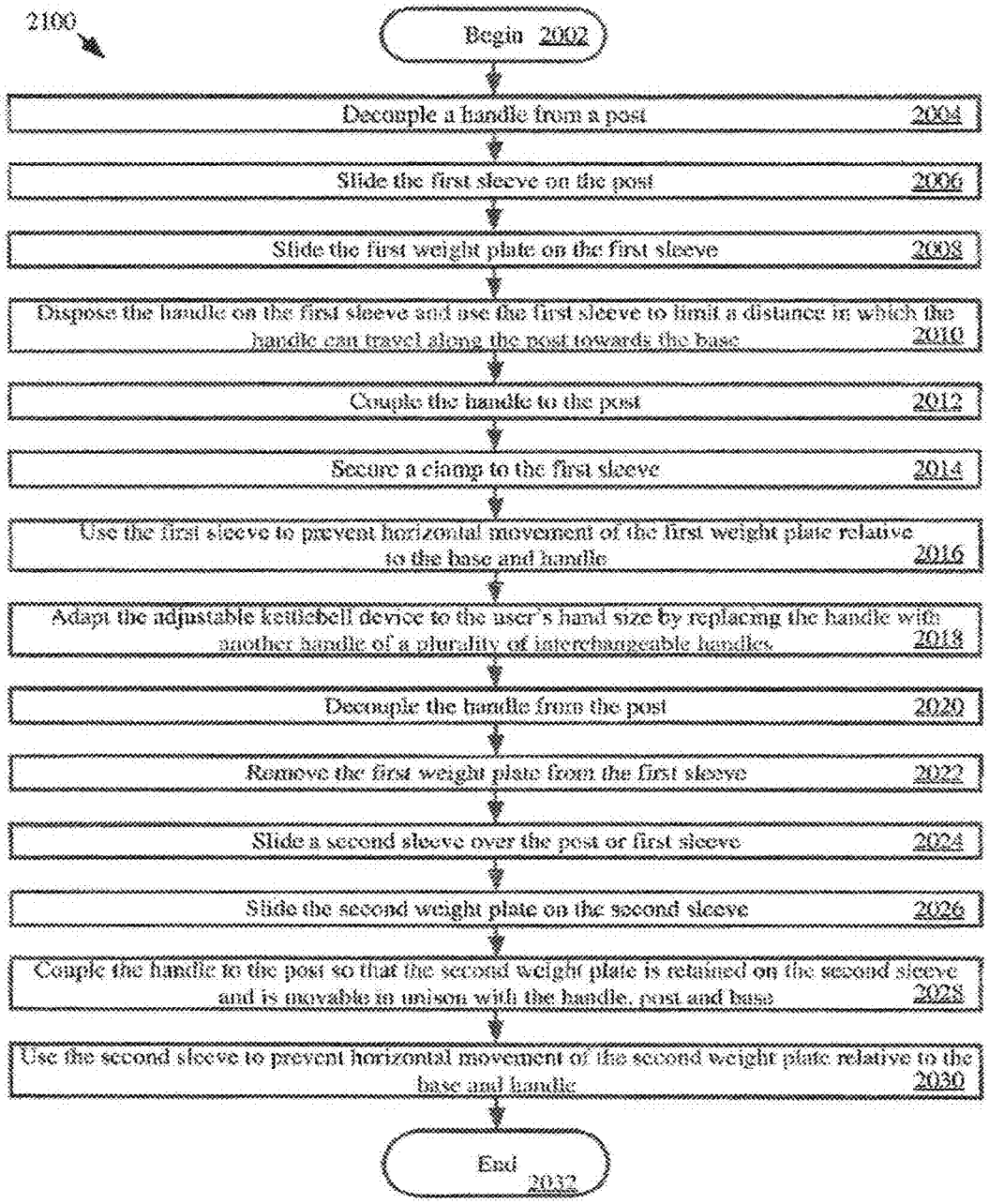
FIG. 21 is a flow diagram of another illustrative method for using an adjustable kettlebell device.

Referring now to FIG. 21, there is provided a flow diagram of an illustrative method 2100 for using an adjustable kettlebell device (e.g., adjustable kettlebe111100 of FIG. 11). Method 2100 begins with 2102 and continues with 2104 where a handle (e.g., handle 104 of FIG. 1) is decoupled from a post (e.g., post 106 of FIG. 1). A first sleeve (e.g., sleeve 1108 of FIG. 11) is slid over the post in 2106. The first sleeve has a first outer diameter that allows the adjustable kettlebell device to be compatible with a first weight plate (e.g., weight plate 1300 of FIG. 13) of a first type (e.g., a standard weight plate type). Next in 2108, the first weight plate is slid on the first sleeve.

The handle is then disposed on the first sleeve in 2110. The first sleeve is used to limit the distance in which the handle can travel along its elongate length towards a base (e.g., base 102 of FIG. 1). In this regard, the first sleeve has a length short than the length of the post.

In 2112, the handle is coupled to the post so that the first weight plate is retained on the first sleeve and is movable in unison with the handle, post and base. Notably, the first sleeve is used to structurally support the handle and maintain the handle's position relative to the base.

A clamp may optionally be secured to the first sleeve as shown by 2114. The clamp is provided to prevent vertical movement of the first weight plate along an elongate length of the first sleeve during a first period of time when the adjustable kettlebell device is being used for exercise purposes.

In 2116, the first sleeve is used to prevent horizontal movement of the first weight plate relative to the base and handle when the adjustable kettlebell device is being held by a user for exercise purposes during the first time period. The adjustable kettlebell device is optionally adapted to the user's hand size (or for any of a number of ergonomic or aesthetic reasons) in 2018 by replacing the handle with another handle of a plurality of interchangeable handles (e.g., interchangeable handles 104 of FIGS. 1 and/or 502-508 of FIG. 5).

Thereafter in 2120, the handle is decoupled from the post. The first weight plate is removed from the first sleeve in 2122. In 2124, a second sleeve (e.g., sleeve 1110 of FIG. 11) is slid over the post or first sleeve. The second sleeve has a second outer diameter that allows the adjustable kettlebell device to be compatible with a second weight plate of a second type (e.g., an Olympic type) different from the first type. In 2126, the second weight plate is slid on the sleeve.

Thereafter in 2128, the handle is coupled to the post so that the second weight plate is retained on the second sleeve and is movable in unison with the handle, post and base. In 2130, the second sleeve is used to prevent horizontal movement of the second weight plate relative to the base and handle when the adjustable kettlebell device is being held by the user for exercise purposes during a second time period. Subsequently, 2132 is performed where method 2100 ends.

Various configurations of the present solution are possible. For example, the dimensions of the device may vary. Dimensions shown in the drawings are approximate and differences in length, depth, height and diameter and weight of components are possible without affecting the basic design and performance of the device. The types of materials of various components of the device may also vary. For example, the device could be made of different types and combinations of materials, examples of which are noted below and which are not meant to be all-inclusive. A certain material can be used exclusively throughout the design or in combination with other materials and would still provide the key functionality described throughout this document. There are several potential advantages to using different materials or combinations of materials: (1) wider array of exercises possible (e.g., specialized exercises for injury rehabilitation, increased repetitions, etc.); and (2) broader range of users such as people new to kettlebells—or exercise, in general. The present solution can be used to help people with special needs (such as those needing physical therapy or rehabilitation from injury or illness, elderly, or anyone with a cognitive or physical disability where lighter weights would be beneficial). The manufacturing process may also be simplified in various ways to reduce costs.

In some non-limiting examples, the metal can be: stainless steel, aluminum, cast iron throughout the design or different metals for different components in any combination. For example, the device may have a combination of A36 steel for the base and vertical post and aluminum for the kettle handle. All or part of the device could be made of solid and/or hollow plastic. The use of plastic could reduce the overall weight of the device which would allow the use of lighter weights for a variety of people and purposes such as new users of kettle bells, people with special needs, to accommodate special exercises (e.g., for physical therapy and rehabilitation), or simply for those who do not yet have the strength or skill to exercise with a heavier version of the device (e.g., partially or 100% metal). Rubber or other composite materials may also be used.

The various embodiments disclosed in this document provide advantages over the traditional kettlebells and existing adjustable kettlebells, whether standalone or combined. The illustrated device uses removable hollow sleeves that slide over the rigid, fixed vertical post that is attached to the center of the base plate. Because the diameter of the vertical post and the sleeves is variable, any suitable type of weight plate can be accommodated, including, for example, standard weight plates (e.g., 1" diameter center hole) and Olympic plates (e.g., 2" diameter center hole). The variability of the post and sleeve diameters also allows for an application in which non-standard or custom weight plates could be used. This functionality improves upon existing products/designs by giving users the choice of what type of weight to use —standard weight plates, Olympic style weights or other types of weight plates (and the ability to switch between types/styles of weights in seconds).

The above illustrated device is a top-loading device in that the handle component is supported from underneath, for example, by one or more removable hollow sleeves that slides over the vertical post and rest below the kettle handle on the base plate. Because of these design elements, the handle simply sits atop the sleeve(s) which means that it can be quickly and easily slid off/onto the post. This means that, in turn, weight plates can also be quickly and easily slid off/onto the post. This provides an improvement over other products/designs by dramatically improving the simplicity, speed and efficiency of changing weights.

Furthermore, the post may have a top end that is narrower in diameter than the diameter of the lower portion thereof to allow the handle to directly rest thereon without requiring the sleeves. Even further, when the top end of the post has a narrower diameter allowing the lower portion of the post to provide support to the handle, the post may also be made in various diameters to accommodate various sizes of the weight plates. For example, the lower portion of the post may be made to have a diameter of one inch to be able to receive standard weight plates or 2 inches to be able to receive Olympic weights. The narrower top end configuration allows the device to function without requiring the use of sleeves. Alternatively, the lower portion of the post can be configured with a diameter to accommodate standard weight plates and then a sleeve with a 1 inch inner diameter and a 2 inch outer diameter can be slid over the post to accommodate Olympic plates. With proper materials and manufacturing employed (e.g., metal casting/welding), the device can be loaded with 100 or more pounds. Accordingly, the above illustrated solution provides the same exercise functionality of traditional kettle bells and existing adjustable kettlebell devices but improves upon these systems by, amount of other advantages, allowing users to: (A) adjust both the amount of weight and the type of weight very quickly, (B) change the type of weight quickly and efficiently, and (C) increases the weight from 10 pounds to over 100 pounds and to do so with speed and efficiency. Accordingly, the weight of the device can be adjusted in literally a fraction of the time that it takes for most, if not all, other adjustable kettlebell devices.

In embodiments, a coating for some or all components of the kettlebell may be provided. In embodiments, the coating may be conventional liquid paint which may be delivered via an evaporating solvent, such as by spraying or dipping. In embodiments, the coating may be a powder coating that may be applied electrostatically and then cured under heat or ultraviolet light. Such powder may be a thermoplastic or a thermoset polymer which creates a finish that may be harder and more durable than conventional paint. In embodiments, the coating may comprise plastic, composite plastic, natural or synthetic rubber, neoprene, or any other material or combination of materials deemed appropriate for one or more purposes. Coating materials may be different for different components. Further, the coating may be applied in a variety of thicknesses, which may be different for different components. In embodiments, the coating may be applied as part of the manufacturing process. Alternatively or in addition, he coating may be applied or added after the manufacturing process is complete.

A coating on some or all of the kettlebell components may serve various purposes. For example, the coating may provide a surface that is easier to grip or manipulate. A coating may also provide a cushion to prevent or mitigate injury to the user or damage to objects in the exercise area. For example, when a user swings the kettlebell, it might accidentally impact the user's leg or other body part. Further, the kettlebell might accidentally impact a nearby object, such as a wall, weight rack, exercise machine, or the like, or even a nearby person. A shock absorbing coating on the kettlebell or one or more of its components, such as a rubber or other tough deformable coating, may cushion an impact with a swinging kettlebell, preventing or mitigating damage or injury.

In embodiments, the base of the adjustable kettlebell may be configured in any of a wide variety of shapes, either planar or non-planar. For example, a kettlebell may take the form of a volume of revolution such as an egg shape standing on end, an oval, or the like. The kettlebell may take a form based on any desired shape. For example, if based on a square, it may take the form of a cube, square geometric prism, a a square frustrum, or the like. Further, the kettlebell may take a form based on a half-oval, frustum, or section of a cone or sphere or the like. Moreover, any desired two dimensional shape may serve as the base of the kettlebell.

Figure 32A:
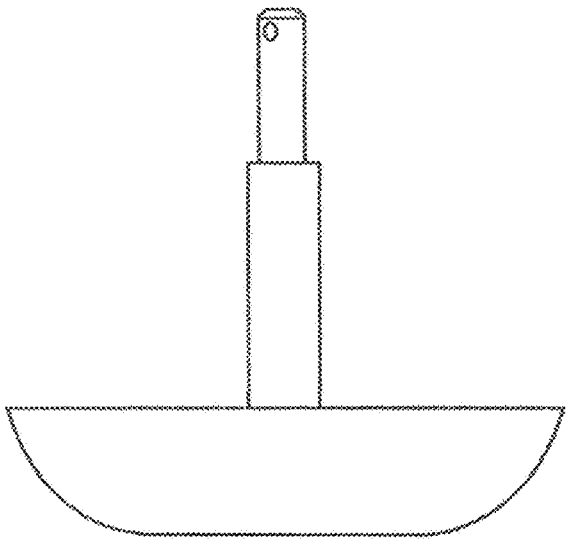
FIGS. 32A and 32B illustrate a side view and a perspective view, respectively, of an exemplary embodiment with a flat bottom.
Figure 32B:
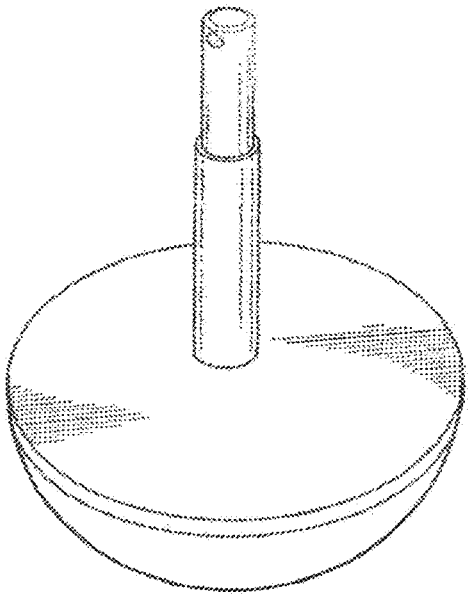

Different dimensions and shapes might provide additional functionality for the user. For example, the use of a spherical segment or spherical frustum (defined by cutting a sphere with a pair of parallel planes) which could provide a thicker base with a curved edge. Such an embodiment is illustrated in FIG. 32A (side view) and 32B (perspective view). This shape provides a user with a smooth, curved surface that may allow for a better, more ergonomic fit of the kettelbell against areas of the user's body such as the wrist, forearm, and shoulder, which in turn may provide improved functionality during certain movements that require the kettlebell to rest against or contact certain areas of the body.

Other functional differences and benefits may derive from a kettlebell as described above, as well as other dimensional and shape configurations, without departing from the scope of the present solution.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. An adjustable kettlebell device, comprising:

a base;

a post having a first end securely coupled to the base and configured to slidingly receive a standard weight plate thereon;

a sleeve disposed on the post and configured to slidingly receive an Olympic weight plate thereon;

a handle comprising a flat plate having an aperture through which an upper portion of the post extends, the upper portion of the post extending through the aperture such that part of the post is above and part of the post is below the flat plate, the flat plate being affixed to a block handle, the block handle having a straight intermediate portion, the straight intermediate portion having opposing ends, the block handle having a pair of legs each of which is connected to a respective opposing end of the straight intermediate portion such that the pair of legs are inwardly directed toward the post and affixed to the flat plate such that the legs directly contact the flat plate, the flat plate having a flat upper surface to which the pair of legs are affixed, the flat upper surface having an area that is greater than a transverse cross sectional area of the pair of legs, the transverse cross sectional area being perpendicular to a respective longitudinal axis of the pair of legs, the handle removably coupled to the post by the aperture in the flat plate and configured to facilitate an addition or removal of at least one of the standard weight plate and the Olympic weight plate from the adjustable kettlebell device;

a stop mechanism connected to or formed on the post between the first end and a second end of the post, the stop mechanism being located between the upper portion of the post and a bottom portion of the post, the stop mechanism allowing movement of the handle along the upper portion, the stop mechanism obstructing the movement of the handle along the post from the upper portion to the bottom portion to limit a distance the handle can downwardly move along the post;

wherein the post prevents horizontal movement of the at least one standard weight plate and the Olympic weight plate relative to the base and handle when the adjustable kettlebell device is being used for exercise purposes.

2. The adjustable kettlebell device according to claim 1, wherein the handle is removably coupled to the post by:

a pin inserted through an opening proximate the second end of the post that coincides with the upper end of the post; and a threaded nut twisted onto matching threads on the post adjacent to the second end of the post such that the opening proximate the second end of the post is above the threaded nut.

3. The adjustable kettlebell device according to claim 2, wherein the pin is angled such that a longitudinal central axis of the pin forms an angle between opposite ends of the pin.

4. The adjustable kettlebell device according to claim 1, wherein the post comprises a plurality of spaced apart through holes.

5. The adjustable kettlebell device according to claim 4, wherein the plurality of spaced apart through holes are vertically aligned on the post.

6. The adjustable kettlebell device according to claim 4, wherein the plurality of spaced apart through holes are not vertically aligned on the post.

7. The adjustable kettlebell device according to claim 4, wherein the plurality of spaced apart through holes are disposed at regular vertical intervals on the post.

8. The adjustable kettlebell device according to claim 4, wherein the plurality of spaced apart through holes are not disposed at regular vertical intervals on the post.

9. The adjustable kettlebell device according to claim 1, wherein at least one of the post and the sleeve is used to structurally support the handle and maintain a position of the handle relative to the base.

10. The adjustable kettlebell device according to claim 1, wherein the post or the sleeve is used to limit a distance in which the handle travels along the post towards the base such that the post or the sleeve defines the stop mechanism.

11. The adjustable kettlebell device according to claim 1, further comprising at least one quick release clamp secured to at least one of the post and the sleeve to prevent vertical movement of at least one of the standard and Olympic weight plates along an elongate length of the post.

12. The adjustable kettlebell device according to claim 1, further comprising at least one additional handle of a different size or shape than the handle, configured to adapt the adjustable kettlebell device to a different user's hand size.

13. The adjustable kettlebell device according to claim 1, further comprising a coating applied to at least one component of the adjustable kettlebell device.

14. The adjustable kettlebell device according to claim 13, wherein the coating is applied as one of a paint and a powder.

15. The adjustable kettlebell device according to claim 1, wherein the base has a form of a spherical frustum.

16. The adjustable kettlebell device according to claim 1, wherein the base has a form of a cylinder having a transverse dimension and a thickness wherein the transverse dimension is larger than the thickness, the cylinder having an outer edge, the outer edge having an upper portion that is curved inwardly.

17. The adjustable kettlebell device according to claim 1, the stop mechanism comprises a ledge formed by a transverse dimension of the bottom portion of the post being greater than a transverse dimension of the upper portion of the post such that the ledge defines the stop mechanism.

18. The adjustable kettlebell device according to claim 1, wherein the Olympic weight plate has an aperture through which the sleeve slidingly receives the Olympic weight plate, the Olympic weight plate having an outwardly extending opening in addition to the aperture, the outwardly extending opening extending through a thickness of the Olympic weight plate.

19. The adjustable kettlebell device according to claim 1, wherein the post is unitary.

* * * * *